US010028881B2

(12) United States Patent
Yamamoto et al.

(10) Patent No.: US 10,028,881 B2
(45) Date of Patent: Jul. 24, 2018

(54) SWINGING LEG PENDULUM MOVEMENT AID FOR WALKING, AND ASSISTANCE FORCE CONTROL METHOD

(71) Applicants: KYUSHU UNIVERSITY, NATIONAL UNIVERSITY CORPORATION, Fukuoka-shi, Fukuoka (JP); TOKAI RUBBER INDUSTRIES, LTD., Komaki-shi, Aichi (JP)

(72) Inventors: Motoji Yamamoto, Itoshima (JP); Shin-ichiro Takasugi, Fukuoka (JP); Masanori Sato, Fukuoka (JP); Takahiro Komatsu, Nagoya (JP); Kazunobu Hashimoto, Nagoya (JP)

(73) Assignees: KYUSHU UNIVERSITY, NATIONAL UNIVERSITY CORPORATION, Fukuoka (JP); SUMITOMO RIKO COMPANY LIMITED, Komaki (JP)

( * ) Notice: Subject to any disclaimer, the term of this patent is extended or adjusted under 35 U.S.C. 154(b) by 813 days.

(21) Appl. No.: 14/182,973

(22) Filed: Feb. 18, 2014

(65) Prior Publication Data

US 2014/0163435 A1 Jun. 12, 2014

Related U.S. Application Data

(63) Continuation of application No. PCT/JP2013/003371, filed on May 28, 2013.

(30) Foreign Application Priority Data

Jul. 20, 2012 (JP) ..... 2012-162113

(51) Int. Cl.
*A61H 3/00* (2006.01)
*A61H 1/02* (2006.01)

(52) U.S. Cl.
CPC ..... *A61H 3/00* (2013.01); *A61H 1/0244* (2013.01); *A61H 2201/1215* (2013.01);
(Continued)

(58) Field of Classification Search
CPC ..... A61H 1/0244; A61H 3/00; A61H 2201/1664; A61H 2201/5069;
(Continued)

(56) References Cited

U.S. PATENT DOCUMENTS 7,563,393 B2 7/2009 Hayakawa et al.
7,958,789 B2 6/2011 Hayakawa et al.
(Continued)

FOREIGN PATENT DOCUMENTS

JP A-2006-204426 8/2006
JP 2007-000391 A 1/2007
(Continued)

OTHER PUBLICATIONS

Jul. 16, 2015 Exetended Search Report issued in European Patent Application No. 13820076.1.
(Continued)

*Primary Examiner* — Justine Yu
*Assistant Examiner* — Douglas Sul
(74) *Attorney, Agent, or Firm* — Oliff PLC

(57) ABSTRACT

A swinging leg pendulum movement aid for walking including a pair of assisting units for a left leg and a right leg each having a drive source for applying a pulling force to an auxiliary force transmission part, a joint angle sensor for detecting a joint angle of user's hip joints, and a control member for driving the drive sources of the respective assisting units corresponding to changes in the joint angle and applying an assistance force in a forward swinging
(Continued)

direction to the swinging leg that kicked off a ground so as to aid a pendulum movement of the swinging leg.

11 Claims, 17 Drawing Sheets

(52) U.S. Cl.
CPC .. *A61H 2201/149* (2013.01); *A61H 2201/165* (2013.01); *A61H 2201/1664* (2013.01); *A61H 2201/5007* (2013.01); *A61H 2201/5069* (2013.01)

(58) Field of Classification Search
CPC ..... A61H 2201/5007; A61H 2201/165; A61H 2003/007; A61H 1/00
See application file for complete search history.

(56) References Cited

U.S. PATENT DOCUMENTS 8,237,390 B2 * 8/2012 Godler ..... B25J 9/126 318/560
8,451,011 B2 5/2013 Hayakawa et al.
2003/0093021 A1 5/2003 Goffer
2004/0116260 A1 * 6/2004 Drennan ..... A61F 5/0193 482/124
2006/0094989 A1 5/2006 Scott et al.
2007/0123997 A1 * 5/2007 Herr ..... A61F 2/60 623/27
2008/0000317 A1 * 1/2008 Patton ..... A61F 5/0102 74/500.5
2008/0234608 A1 9/2008 Sankai
2009/0270766 A1 * 10/2009 Yasuhara ..... A61H 3/00 600/595
2010/0094188 A1 * 4/2010 Goffer ..... B25J 9/0006 602/23
2010/0144490 A1 * 6/2010 Purdy ..... A63B 21/0004 482/1
2011/0040216 A1 * 2/2011 Herr ..... A61F 2/60 601/34
2011/0218466 A1 9/2011 Takahashi et al.
2012/0016278 A1 * 1/2012 Nakashima ..... A61H 1/024 601/34
2012/0226203 A1 * 9/2012 Nakashima ..... A61H 3/00 601/34
2013/0197408 A1 * 8/2013 Goldfarb ..... A61F 5/0102 601/35
2014/0012164 A1 * 1/2014 Tanaka ..... B25J 9/0006 601/35

FOREIGN PATENT DOCUMENTS

JP B2-4200492 12/2008
JP A-2010-075658 4/2010
JP A-2010-110464 5/2010
WO 2011/008934 A2 1/2011

OTHER PUBLICATIONS

International Search Report issued in International Application No. PCT/JP2013/003371 dated Jul. 2, 2013.
May 12, 2017 Office Action issued in European Patent Office Application No. 13820076.1.
Dec. 12, 2017 Office Action issued in European Patent Application No. 13820076.1.

* cited by examiner

CALCULATION OF LENGTH OF AUXILIARY FORCE TRANSMISSION BAND (AC)

$$AC = \sqrt{AB^2 + BC^2 - 2AB \cdot BC \cos\left(\pi - \tan^{-1}\frac{OA}{OB} - \theta\right)}$$

RELATIONSHIP BETWEEN ASSISTANCE TARGET VALUE AND ASSISTANCE FORCE

RELATIONSHIP BETWEEN ASSISTANCE TIMING AND WALKING STATE

CONFIRMATION OF EMG WAVEFORM OF CALF MUSCLES

RESULT : MUSCLE ELECTRIC POTENTIAL IN AREA OF 20 TO 40% OF WALKING CYCLE DECREASED

SWINGING LEG PENDULUM MOVEMENT AID FOR WALKING, AND ASSISTANCE FORCE CONTROL METHOD

INCORPORATED BY REFERENCE

The disclosure of Japanese Patent Application No. 2012-162113 filed on Jul. 20, 2012 including the specification, drawings and abstract is incorporated herein by reference in its entirety. This is a Continuation of International Application No. PCT/JP2013/003371 filed on May 28, 2013.

BACKGROUND OF THE INVENTION

1. Field of the Invention

The present invention relates to a swinging leg pendulum movement aid for walking and an assistance force control method. This invention is used by a person with decreased walking ability or the like, and promotes walking movement using his own muscle strength by supporting walking movement with a small force. For example, by increasing the walking speed, the invention is able to effectively suppress a decrease in muscle strength. Meanwhile, when keeping a fixed walking speed, for example, the invention is able to assist longer distance walking by walking being supported for a long period with a lower amount of energy.

2. Description of the Related Art

From the past, to support walking of a physically disabled person or elderly person with low muscle strength, assistive devices to be worn such as those disclosed in U.S. Publication No. US 2008/0234608 and U.S. Publication No. US 2011/0218466 have been proposed.

Meanwhile, the assistive devices of the conventional structure noted in these US 2008/0234608 and US 2011/0218466 are exoskeleton type assistive devices, in which the exoskeleton is made from a rigid arm or frame and is worn along the user's body. By the exoskeleton being driven by a motor at the joints, the user's leg is made to move together with the exoskeleton arm.

However, the conventional assistive devices which used this kind of rigid exoskeleton all aided the muscle strength of the leg on the grounding side. The leg on the grounding side which requires high muscle strength so as to support the body weight or the like with two legged walking which repeats alternately grounding and floating in relation to the ground. Because of that, there was the problem that it was difficult to avoid the device from becoming larger or heavier because a large output was required.

In fact, with the conventional assistive devices that aid the muscle strength with a large output assistance for the grounding side leg muscle strength, as a result of being able to do this with little burden on the muscle strength of the user himself, there was the problem that it was difficult to expect an effect of developing the user's own muscle strength and suppressing a decrease in muscle strength. Because of that, particularly with a person with decreased walking ability referred to as locomotive syndrome or the like for which there is a walking disability for a reason such as aging or the like, but does not go so far as being unable to walk, even when using an assistive device which performs muscle strength assistance to the grounding leg using a conventional rigid skeleton structure, it is difficult to expect maintaining or improvement of walking ability, and this was not necessarily effective for inhibiting a shift toward a serious walking disability to the point of being unable to stand and walk.

Also, with a conventional rigid exoskeleton structure assistive device, if it did not match the user's physical build correctly, or it was not worn properly, there was also the risk of excessive force being applied to the user's joints or the like during exercise due to the rigidity of the exoskeleton.

In addition, from the fact that the movement of the user's joints is constrained by the rigid exoskeleton, for example when there is a disturbance such as external force or the like in the horizontal direction on the user, there was also the risk of obstruction to movement to prevent falling down by spontaneous reaction of the user, leading to falling over.

SUMMARY OF THE INVENTION

The present invention has been developed with the circumstances described above as the background, and it is therefore one object of this invention to provide a movement aid for walking based on a novel technical concept focusing on the swinging leg that is used by a person with decreased walking ability or the like, and by supporting walking movement with a small force, promotes walking movement using his own muscle strength, and is able to effectively suppress a decrease in muscle strength.

Also, the present invention has another object of providing a novel movement aid for walking which, in addition to having a simple structure and being light in weight, is able to safely exhibit a muscle strength training effect by effectively supporting the walking of the user without excessively constraining instantaneous and unexpected movement by the user himself as a danger avoidance reaction against disturbances or the like.

A first mode of the present invention is a swinging leg pendulum movement aid for walking, comprising: a pair of assisting units for a left leg and a right leg, each of the assisting units including an auxiliary force transmission part having flexibility, a first wearing part configured to be worn on a leg side with respect to a user's hip joint, a second wearing part configured to be worn on a lumbar side with respect to the user's hip joint, and a drive source for applying a pulling force to the auxiliary force transmission part, the first wearing part and the second wearing part are disposed at opposite end parts of the auxiliary force transmission part; a joint angle sensor for detecting a joint angle of a front-back direction of the user's hip joints; and a control member that detects from a detection value of the joint angle sensor a state for which the leg that extended to a back when the user is walking has kicked off a ground and becomes a single leg standing state, implements drive control on the drive source, and applies the pulling force to the auxiliary force transmission part of the swinging leg that kicked off the ground so as to apply an assistance force in a forward swinging direction to aid a pendulum movement of the swinging leg.

The movement aid constituted according to the first mode applies an assistance force on the swinging leg, with a focus on an effect of making the walking energy more efficient or the like through the pendulum movement of the swinging leg when a person is walking with two legs. As a result, the pendulum movement of the swinging leg when walking is actively increased, and a mechanical aid effect for walking movement is achieved by increasing the movement energy using the swinging leg pendulum movement. In addition to that, by applying supporting force to the swinging leg at an appropriate time, and by realizing the original movement of the swinging leg when doing walking movement, there is an improvement in the disorder and phase skewing of the coordinated movement of all the body parts when walking for a person with decreased walking ability, and it is possible to restore walking efficiency and rhythm.

Therefore, with the movement aid of this mode, in contrast to the aid devices of the conventional structure with the goal of aiding using a large force on the muscle strength of the grounding leg, precise and efficient support of walking is given with a small output, restoring the coupled motion of the body parts using the original walking system for a person with decreased walking ability or the like. Besides, it is possible to also exhibit an effect of suppressing a decrease in muscle strength by working the muscle strength of the user with the grounding leg, and to have spontaneous promotion of walking. As a result, a suppression effect is effectively achieved on a decrease in walking movement function, so it is possible to expect improvements in walking function, making it possible to exhibit an excellent training effect on the initial stages of locomotive syndrome or the like due to movement disorders.

In fact, the movement aid of this mode aids walking efficiency and rhythm by applying assistance force to the swinging leg and reduces the burden of independent walking. Thus, compared to aid devices using a conventional structure with the goal of having a large aid force action on the grounding leg for bearing bodyweight, only a small output is required, so it is possible to make the device smaller and lighter, and it is also easy to use.

Additionally, with the movement aid of this mode, the auxiliary force transmission part has flexibility and allows deformation. Therefore, compared to a walking movement aid having a rigid exoskeleton, it is possible for the user to easily put this on and remove it. In fact, based on the deformation of the flexible auxiliary force transmission part, it is possible to do various daily life actions such as sit in a chair, walk sideways or the like with the movement aid worn. Since there is not excessive constraint of user movement or excessive burden on the joints or the like as was the case with conventional structure exoskeleton type walking movement aids, it is possible to maintain and improve muscle strength and nervous system function through the natural actions of daily life. Also, since the physical and mental burden of wearing the movement aid is reduced for the user, continuous wearing can be realized. Furthermore, even when there is a disturbance such as a lateral external force or the like on the user during walking, action to prevent falling over by the spontaneous reaction of the user is permitted, improving safety.

A second mode of the present invention is the swinging leg pendulum movement aid for walking according to the first mode, wherein the first wearing part of the assisting unit is configured to be worn within a range from a distal end of a femur to a proximal end of a tibia.

With the movement aid of this mode, by setting the second wearing part at a position separated from the hip joints, it is possible to implement the assistance force by the drive source even more efficiently on the leg via the assisting unit. Because of that, the output required for the drive source is reduced, and further lightness and compactness of the movement aid in accordance therewith can be realized.

A third mode of the present invention is the swinging leg pendulum movement aid for walking according to the second mode, wherein by the first wearing part of the assisting unit being worn at the proximal end of the tibia, the assistance force by the assisting unit is implemented at a below the knee part of the swinging leg.

With the movement aid of this mode, the assistance force is applied below the knee as well as on the thigh of the swinging leg. This makes it possible to exhibit an even more efficient aiding effect on the pendulum movement of the entire leg. Specifically, two legged walking can be represented as a compass model using movement of the hip joints, but more accurately, it can be expressed as a model considering the coupled motion of the hip joints and the knee joints. Then, by performing support of the lower leg for coupled motion combining the pendulum movement of the thigh around the hip joint and the pendulum movement of the lower leg around the knee joint, it is possible to have energetic pendulum movement of the leg with even better efficiency and to perform walking assistance.

A fourth mode of the present invention is the swinging leg pendulum movement aid for walking according to any of the first through third modes, further comprising a memory member for storing control information relating to drive timing information and drive output information for driving each drive source with the left and right pair of assisting units corresponding to changes in the joint angle with the user's hip joints, wherein the control member does drive control of each drive source with the left and right pair of assisting units based on the control information of the memory member, and aiding of the pendulum movement of the swinging leg is done by the joint angle sensor detecting the leg extended to the back during walking by the user having kicked off the ground and reached a single leg standing state, and applying the assistance force in the forward swinging direction on the swinging leg that kicked off the ground.

With the movement aid of this mode, to aid the pendulum movement of the swinging leg of each user, the drive source is driven at the optimal timing and output according to each user. Specifically, it is possible to freely set the drive timing of the drive source for each user by adjusting the drive source to drive at the point that the hip joint is at a designated angle. Also, by adjusting the size of the output of the drive source, it is possible to freely set the size of the assistance force applied to the swinging leg for each user. When a person is doing walking movement, the hip joint angle can be detected as needed by the joint angle sensor, and the drive source can be set to be driven at a designated angle, or the drive source can be set to be driven at a fixed period from the designated angle.

A fifth mode of the present invention is the swinging leg pendulum movement aid for walking according to the fourth mode, wherein the memory member stores bending prevention control information to follow an effective length of the auxiliary force transmission part of the assisting unit corresponding to changes in the joint angle of the user's hip joints, and the control member does drive control of the respective drive sources of the left and right pair of assisting units so as to keep a fixed tensile force action state of the auxiliary force transmission part corresponding to changes in the joint angle based on the bending prevention control information stored in the memory member.

With the movement aid of this mode, the occurrence of bending of the auxiliary force transmission part accompanying changes in the hip joints is reduced or avoided. Thus, the walking support force acting on the legs from the auxiliary force transmission part can be suitably applied to the user effectively and without a big time delay, and it is possible to more accurately control the timing of support force action on the swinging leg.

A sixth mode of the present invention is the swinging leg pendulum movement aid for walking according to any of the first through fifth modes, wherein the control member refers a position at which the leg extended to the back during walking by the user kicks off the ground and becomes the swinging leg as a reference point, and sets a start point of the assistance force based on the detection value of the joint angle sensor such that the start point is set within a range of −15% to +15% of a walking cycle from the reference point.

With the movement aid of this mode, it is possible to more efficiently apply support force on the swinging leg while keeping an appropriate rhythm during walking. Also, with the goal of considering the phase difference in the walking mode by individual differences for each user, it is preferable that the starting point be set to within a range of 15% of before the reference point, or the starting point be set to within a range of 15% after the reference point.

The assistance force applied to the swinging leg preferably cancels the effect on the grounding leg by cancelling after the swinging leg is grounded in front of the user. More preferably, the support force cancellation point is set to the position of 10% or greater of the walking cycle before the grounding point. Also, the assistance force applied to the swinging leg can be applied intermittently to the swinging leg divided into a plurality of times, or can be applied continuously to the swinging leg. The assistance period for which assistance force is continuously or successively applied is preferably set to be 10% or greater of the walking cycle from the starting point, more preferably set to be 20% or greater of the walking cycle from the starting point, and even more preferably set to be 30% or greater. By so doing, it is possible to more effectively apply assistance force to the swinging leg.

A seventh mode of the present invention is the movement aid according to any of the first through sixth modes, wherein the joint angle sensor comprises a sensor made to detect an incline angle in the front-back direction of a femur in relation of a hip bone of the user individually for the left and right leg.

With the movement aid of this mode, when a person is doing walking movement, at the left and right legs, with the angle change of the hip joint that changes in association with the walking cycle as a reference signal, it is possible to independently control the support force to the pair of left and right legs by the respective left and right pair of assisting units. Because of that, for each left and right leg, it is possible to apply support force according to the angle of the hip joint, and also possible to apply support force to the kicking off leg immediately when walking has started, for example. Also, even in cases when a large support force suddenly becomes necessary for only one leg due to a disturbance, it is possible to more quickly realize exhibition of support force.

An eighth mode of the present invention is a control method of an assistance force with a walking movement aid that aids walking movement by applying the assistance force to a leg of a user during walking by the user, wherein when the leg extended to a back kicks off a ground and becomes a single leg standing, an assistance force is applied in a forward swinging direction on the swinging leg that kicked off the ground, to aid a pendulum movement of the swinging leg.

With the control method of this mode, by applying assistance force to the pendulum movement of the swinging leg during walking and aiding the realizing of the original two legged walking posture, the walking movement is supported with a small force, walking movement is promoted using the decreased walking ability person's own movement and muscle strength, and thus it is possible to effectively inhibit a decrease in muscle strength. With this mode, the assistance force applied to the swinging leg can be applied in advance to that leg from before that leg floats up from the ground, or can be applied after the leg floats up from the ground and becomes the swinging leg.

With the present invention, based on a novel technical concept focusing on the swinging leg, it is possible to realize efficient walking as the timing of coupled movement of each part during walking is normalized. As a result, for example with a person with decreased walking ability, the original human walking movement and walking sense is restored, and there is sufficient expectation of obtaining a continuous effect of independent walking such as promotion of walking and a muscle strength maintenance or increase or the like accompanying that.

BRIEF DESCRIPTION OF THE DRAWINGS

The foregoing and/or other objects, features and advantages of the invention will become more apparent from the following description of a preferred embodiment with reference to the accompanying drawings in which like reference numerals designate like elements and wherein:

FIG. 14A shows the support force action on a thigh and FIG. 14B shows the support force action on a lower leg;

DETAILED DESCRIPTION OF PREFERRED EMBODIMENTS

Figure 1:
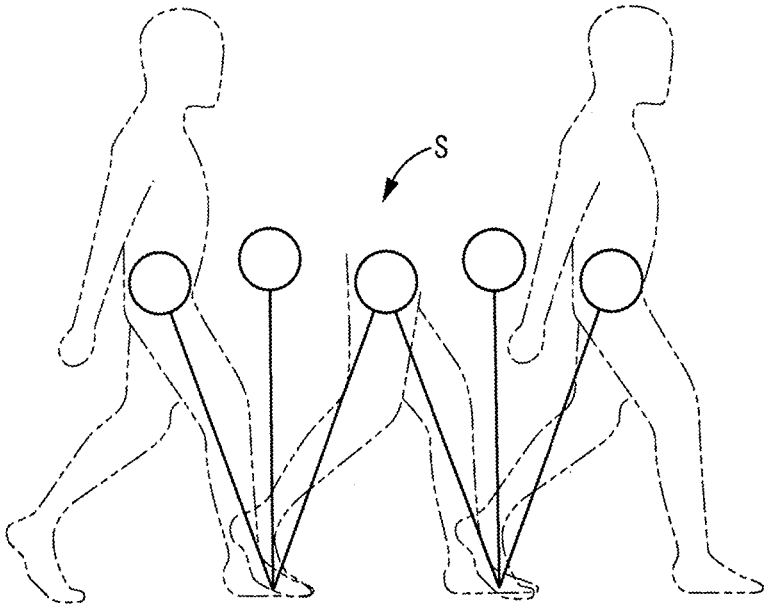
FIG. 1 is a view suitable for explaining an inverted pendulum model as a human walking mechanism.

Following, we will describe embodiments of the present invention while referring to the drawings.

To start, the human walking mechanism is expressed by the inverted pendulum model S shown in FIG. 1. This inverted pendulum model S puts walking into model form using the displacement of the pendulum state of the gravity center with the grounding point as the fulcrum point, and the equation of motion is given by Expression 1.

$$I\theta'' = mgL\theta \qquad \text{[Expression 1]}$$

$$\omega = \sqrt{\frac{g}{L}}$$

L: Distance between the center of gravity and the ankle joint
g: Gravitational acceleration
θ: Angle formed by distance L and the vertical direction
I: Inertia moment
m: Mass of the center of gravity Also, from Expression 1 noted above, the relationship between the center of gravity position (Lθ) and velocity (Iθ') is given by Expression 2 as an energy conservation law.

$$\frac{1}{2}(I\theta')^2 - \frac{1}{2}\omega^2(L\theta)^2 = \frac{E}{m} \qquad \text{[Expression 2]}$$

E/m: Mechanical energy per unit of mass [J/kg]

Here, to continue walking with the center of gravity continuing to move forward, it is necessary to continue compensating for the decrease in the energy sum consisting of the potential energy and the kinetic energy. Therefore, the condition for continuing walking is given by Expression 3.

$$\frac{1}{2}(I\theta')^2 - \frac{1}{2}\omega^2(L\theta)^2 \geq 0 \qquad \text{[Expression 3]}$$

$$\therefore I\theta' \geq \omega L\theta$$

However, as shown by FIG. 2A through 2E, human walking is performed by the left and right pair of legs alternately swinging forward. With this walking operation, in order to maintain the kinetic energy of moving the center of gravity forward against the walking resistance due to a walking surface incline or the like, there is thought to be an important role not just of the energy by the muscle activity of the grounding leg A, but also of the movement of the swinging leg B floating up from the ground.

Figures 2A, 2B, 2C, 2D, 2E:
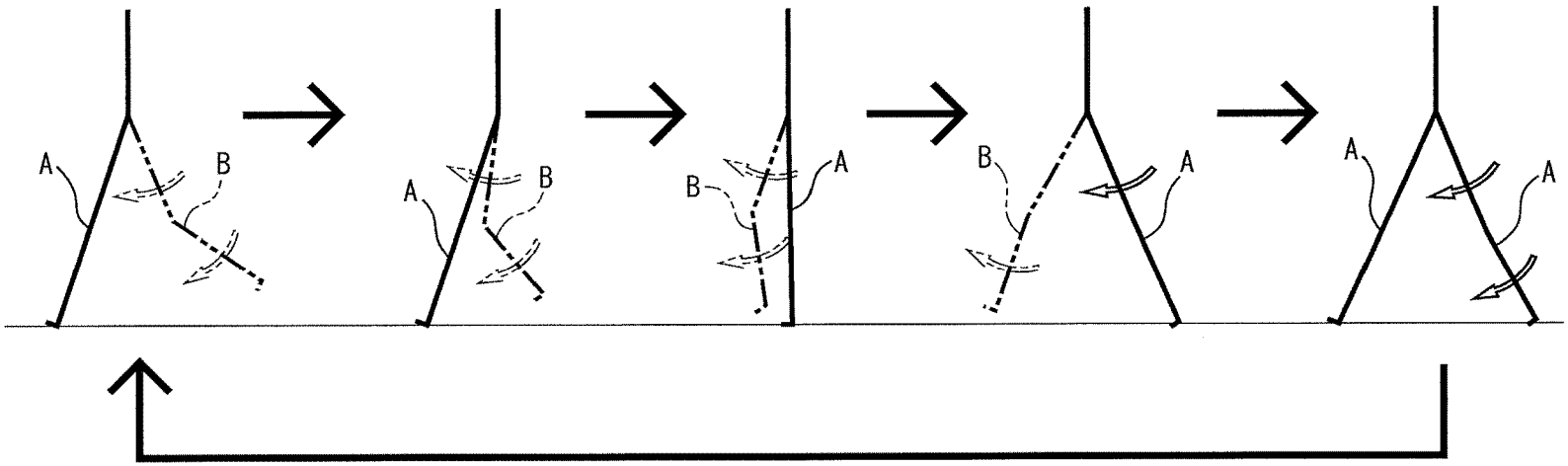
FIGS. 2A-2E are specific views suitable for explaining a movement of a grounding leg and a swinging leg during human walking.

Specifically, as shown in FIG. 2A, the leg that extended to the back when walking becomes the swinging leg B for which the tip of the toe is separated from the ground to the rear of the person's center of gravity, and only the leg A extended to the front is in a state grounded with a single leg standing. After that, during the time shown in FIG. 2B through 2D, walking advances with just the one grounding leg A left as a single leg standing. During this time, the body weight is supported by only the grounding leg A, and since the person is conscious of the muscle strength of the grounding leg A, as described previously, the walking assistance device of the conventional structure had the goal of supporting the muscle strength of this grounding leg A.

On the contrary, the inventor of this invention focused on the swinging leg B floating up from the ground when walking, and by performing support on that swinging leg B, realized a novel walking assistance device that did not exist in the past. Specifically, the swinging leg B floats up from the ground in a state greatly extended out to the back when walking (FIG. 2A), and while swinging downward by the effect of gravity or the like further back than the person's center of gravity, swings out to the front by the swinging around the hip joints. This pendulum movement by the swinging out of the swinging leg B also acts as kinetic energy that advances the center of gravity to the front, especially immediately before the swinging leg B that has swung out to the front is grounded in front of the center of gravity, and by the kinetic energy given from the swinging leg B to the center of gravity, acts to supplement the potential energy that was low, and thus realizes smooth, continuous walking.

However, with a person with decreased walking ability due to aging or the like, the stride length is short and the speed is slow, so it is difficult for the pendulum movement of the swinging leg B to exhibit an effect since sufficient gravity effect cannot be obtained even when that swinging leg B has floated up to the rear. As a result, a person with decreased walking ability is not able to walk smoothly, and walking itself becomes a pain, so they stop walking, leading to even further decrease in leg muscle strength.

Here, with the present invention, by applying supplementary assistance force to the swinging leg B at appropriate timing so as to support the pendulum movement on the swinging leg B, the user's walking is given a rhythm and also made more efficient. In particular, since assistance force is applied to the swinging leg B floating up from the ground, it is possible to assist walking by efficiently doing displacement movement of the swinging leg B with a small force, and also, with the grounding leg A that is grounded and supports the body weight, effective training of muscle strength is also possible by mainly using the user's own muscle strength.

Also, the assistance force applied to the swinging leg B is controlled so as to be given at an appropriate timing when the swinging leg B starts its pendulum movement, making it possible to give the user a sense of rhythm which is important to walking. As a result, it is possible to reduce the psychological stress for the user, and to combine with the kinetic energy physical aid by supporting the pendulum movement of the swinging leg B to further reduce the burden of the user, so this promotes walking over a longer time, more effectively achieving the suppression of the advance of the motor impairment.

Following, we will give a detailed description of the structure and operation of an embodiment of the present invention completed based on this novel technical concept.

Figure 3:
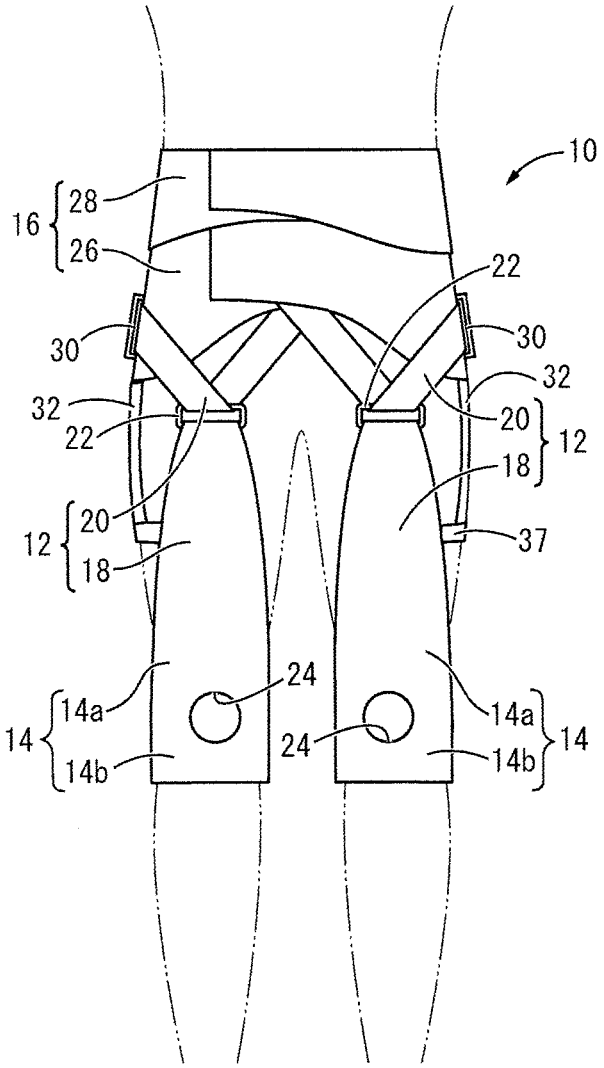
FIG. 3 is a front view showing a walking movement aid as an embodiment of the present invention.
Figure 4:
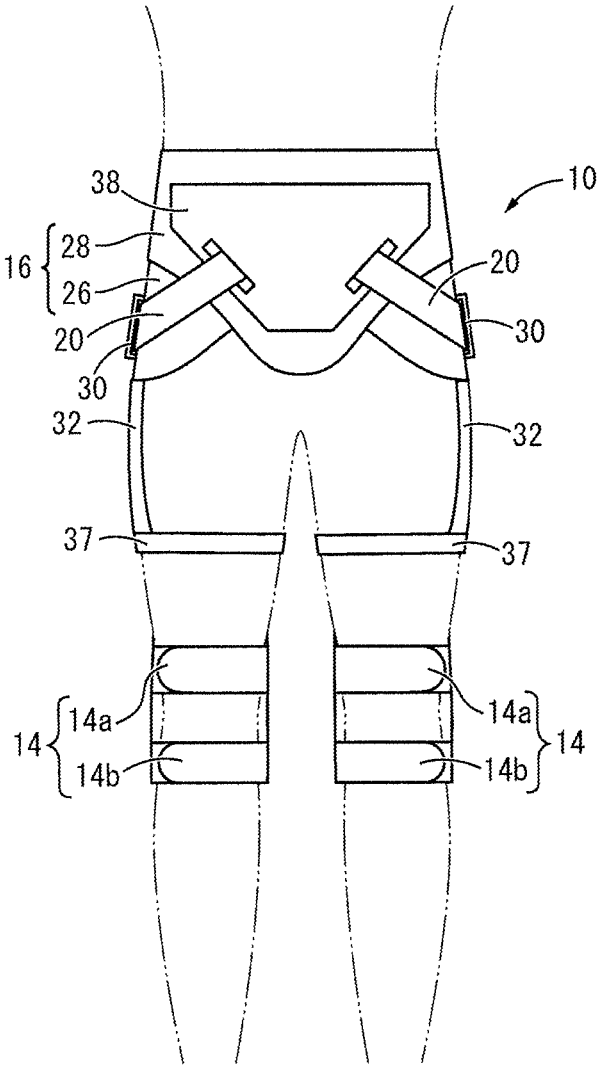
FIG. 4 is a back view of the walking movement aid shown in FIG. 3.
Figure 5:
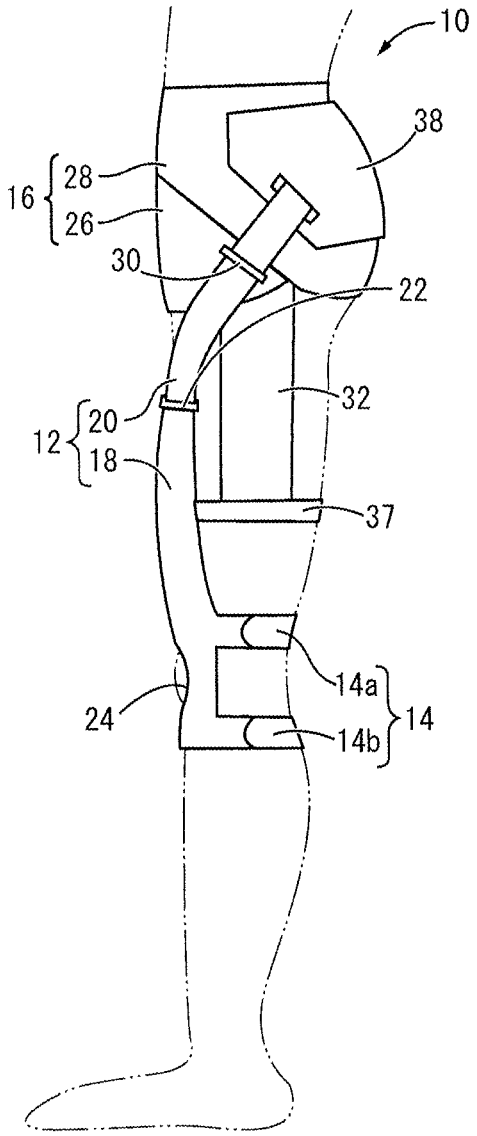
FIG. 5 is a side view of the walking movement aid shown in FIG. 3.

First, in FIG. 3 through 5, as an embodiment of the present invention, a walking movement aid 10 is shown as the swinging leg pendulum movement aid for walking. The walking movement aid 10 is an item that aids waking movement that accompanied by bending and stretching of the hip joints, and has a structure such that on each one of auxiliary force transmission bands 12, 12 as the left and right pair of the auxiliary force transmission parts extending across the hip joints, provided are first wearing parts 14 attached to the thigh side at which the femur is positioned with respect to the user's hip joint, and a shared second wearing part 16 attached to the lumbar side at which the hip bone is positioned with respect to the user's hip joint. Then, these left and right pair of auxiliary force transmission bands 12, 12, the first wearing parts 14, 14, the shared second wearing part 16, and electric motors 40, 40 (see FIG. 7) as the pair of drive sources described later constitute the pair of assisting units for the left and right legs.

In FIG. 3 through 5, the state with the user wearing the walking movement aid 10 is illustrated, and an outline of the user is shown by the double dot-dash line. Also, with the description below, as a rule, the front surface means the surface of the user's abdominal side (front surface), the back surface means the surface on the side of the user's back (rear surface), and vertical means vertical in FIG. 3 which is the vertical up and down direction. Also, with the description below, "assistance force" means the auxiliary force acting in the direction supplementing the force required for the movement of walking or the like, and "resistance force" means the auxiliary force acting in the direction against the force required for movement.

In more detail, the auxiliary force transmission band 12 is constituted with a first traction band 18 and a second traction band 20 respectively formed using fabric connected by a connecting fitting 22 made of metal. The structural parts according to these first traction band 18 and second traction band 20 are all flexibly deformable.

The first traction band 18 is formed with a roughly band shaped fabric or the like extending vertically, and in the state with the walking movement aid 10 worn, is arranged so as to cover the front surface of the user's thigh. The material of the first traction band 18 is acceptable as long as it is a flexible thin material which can be deformed, and considering things such as texture, durability, and breathability, in addition to woven cloth or non-woven cloth, it is also possible to appropriately use leather, a rubber sheet, a resin sheet or the like. In particular with the first traction band 18 of this embodiment, this is elastically deformable in the length direction (the vertical direction in FIG. 1) which is the direction of exertion of the pulling force by the electric motor 40 described later, and the elasticity is made smaller in the width direction (the horizontal direction in FIG. 1) so that deformation is restricted, and there is anisotropy of the deformation volume in relation to input with the length direction and the width direction. With the first traction band 18, in the length direction, it is preferable that there be elasticity of 0.3 $kgf/cm^2$ or greater, and 2.0 $kgf/cm^2$ or less.

Also, the ring shaped connecting fitting 22 is attached to the top end of the first traction band 18, and the first traction band 18 is connected to the second traction band 20 via the connecting fitting 22. The second traction band 20 is a band form having a roughly fixed width dimension, and is formed in a belt form using a cloth using fiber with low elasticity, leather or the like. The auxiliary force transmission band 12 is constituted by the second traction band 20 having its middle part in the lengthwise direction inserted in the connecting fitting 22 and being connected to the first traction band 18.

The second traction band 20 does not necessarily have to have the elasticity kept low, but for at least one of the first traction band 18 and the second traction band 20, so as to improve the wearing feeling by easing the auxiliary force action impact, and to not excessively obstruct movement due to the user's self-awareness, it is preferable to use an item with elasticity made of an elastic fiber for which elastic deformation is allowed in the length direction as described previously.

Also, on the bottom of the first traction band 18 of the auxiliary force transmission band 12 is provided the first wearing part 14 as an integrated unit. With this embodiment, the first wearing part 14 is in a sports supporter form used for protecting knee joints, and for example is formed of a cloth with elasticity and wound on the user's knee joint with a surface fastener, snap, hook or the like. It is also possible to have the first wearing part 14 be formed as a separate unit from the first traction band 18, and to have it adhered later using an adhesive, sewing or the like. Also, it is preferable to make consideration so as not to obstruct bending and stretching of the knee joint by having a through hole 24 formed aligned with the user's patella (knee cap) formed on the first wearing part 14.

In particular with this embodiment, the first wearing part 14 is constituted including an upper winding part **14*a* wound on the distal end of the femur positioned above the knee joint, and a lower winding part 14*b* wound on the proximal end of the tibia positioned below the knee joint. By doing this, the lower end of the auxiliary force transmission band 12 is attached separately to the leg thigh and lower leg, and the pulling force by the auxiliary force transmission band 12**, in other words, the assistance force by the assisting unit, is made to be applied respectively to the distal end (lower end) site of the thigh and the proximal end (upper end) site of the lower leg on the swinging leg B.

Also, both ends of the second traction band 20 of the auxiliary force transmission band 12 are attached to the second wearing part 16. The second wearing part 16 has a transmission band support belt 26 and a drive device support belt 28 each worn on the lumbar area, and one end of the second traction band 20 is attached to the transmission band support belt 26, and the other end is attached to the drive device support belt 28.

The transmission band support belt 26 is formed using a band form cloth with low elasticity, and by winding it on the lumbar area of the user, and connecting both ends using a surface fastener, snap, hook or the like, it is worn on the lumbar area of the user. Also, a pair of guide fittings 30, 30 having a ring shape are provided on the transmission band support belt 26, and in a state with the transmission band support belt 26 worn on the lumbar area, the guide fittings 30, 30 are arranged on the left and right sides of the lumbar area. Then, one end of the second traction band 20 is attached using a means such as sewing, adhesion, a snap, hook, surface fastener or the like near the pubic bone of the front surface part of the transmission band support belt 26.

Figure 6:
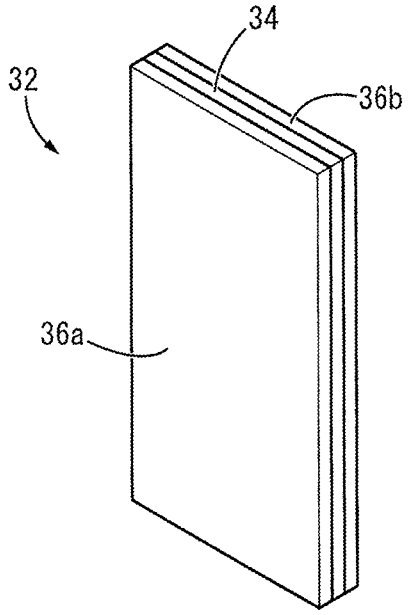
FIG. 6 is a perspective view of a capacitance type sensor constituting the walking movement aid shown in FIG. 3.

Furthermore, attached to the transmission band support belt 26 are a left and right pair of capacitance type sensors 32, 32 as joint angle sensors for detecting the front-back joint angle of the user's hip joints, made to extend facing downward. The capacitance type sensors 32, for example as shown in U.S. Pat. No. 7,958,789 or U.S. Pat. No. 8,451,011, are flexible capacitance change type sensors for which elastic deformation is allowed, and as shown in FIG. 6, have a constitution for which a pair of electrode membranes **36*a* and 36*b* formed using a conductive elastic material are provided on both surfaces of a dielectric layer 34** formed using a dielectric elastic material.

The capacitance type sensors 32 are arranged so as to extend across the thighs from the lumbar area at both sides sandwiching the hip joints, and to overlap and expand along the body side surface. With this embodiment, the upper end of the capacitance type sensor 32 is attached to the transmission band support belt 26 and supported, and the bottom end of the capacitance type sensor 32 is attached to a belt 37 wound on the thigh and worn using a surface fastener or the like.

Then, in the worn state of the transmission band support belt 26, the capacitance type sensor 32 is made to detect changes in the acting pressure by the bending and stretching of the hip joints as changes in the capacitance accompanying approaching or separation of the pair of electrode membranes 36*a* and 36*b*, and the detection signals are input to a control device (46 described later) of a drive device 38 described later. A single capacitance type sensor 32 is overlapped and worn along each left and right body side surface of the user, and the incline angle (hip joint angle) in the front-back direction of the left femur joint in relation to the hip bone and the incline angle (hip joint angle) in the front-back direction of the right femur joint in relation to the hip bone are detected individually.

This change in the hip joint angle can be detected even more accurately by detecting the surface pressure distribution mode of the capacitance type sensor 32, for example. In specific terms, each of the capacitance type sensors 32 are arranged expanding on one surface of each of the left and right body sides of the user, while extending vertically sandwiching the hip joints. When the user is walking and the femur bends forward in relation to the hip bone by one leg swinging forward, of the capacitance type sensors 32, pulling deformation occurs at the area positioned to the back from the body side center, and compression curve deformation occurs in the area positioned to the front from the body side center. Meanwhile, when the leg kicks off to the back, the femur is bent to the back in relation to the hip bone, and of the capacitance type sensors 32, pulling deformation occurs at the area positioned to the front from the body side center, and compression curve deformation occurs in the area positioned to the back from the body side center. Therefore, with each of the capacitance type sensors 32, in which area of front or back sandwiching the body side center line the pulling deformation occurs and in the other area the compression deformation occurs is determined based on the detection value of each area, and it is possible to find the angle change volume of the hip joint based on the size of the detection value according to the level of each change.

In particular, the capacitance type sensors 32 as used with this embodiment are constituted as thin, easily deformable flexible sheets as noted in U.S. Pat. No. 7,958,789 or U.S. Pat. No. 8,451,011, so even when worn along a body surface, there is no excessive sense of discomfort given to the user, and no constraining of the user's spontaneous body movements.

In particular, as shown in FIG. 3 to FIG. 5, the same as with the transmission band support belt 26, the drive device support belt 28 is formed using a band form fabric or the like with low elasticity, and is worn on the lumbar area of the user by being wound on the lumbar area and having both ends connected using surface fasteners, snaps, hooks or the like. Also, with the drive device support belt 28, the back surface part has a large surface area because it extends further downward than the front surface part, and the drive device 38 is equipped on that back surface part.

Figure 7:
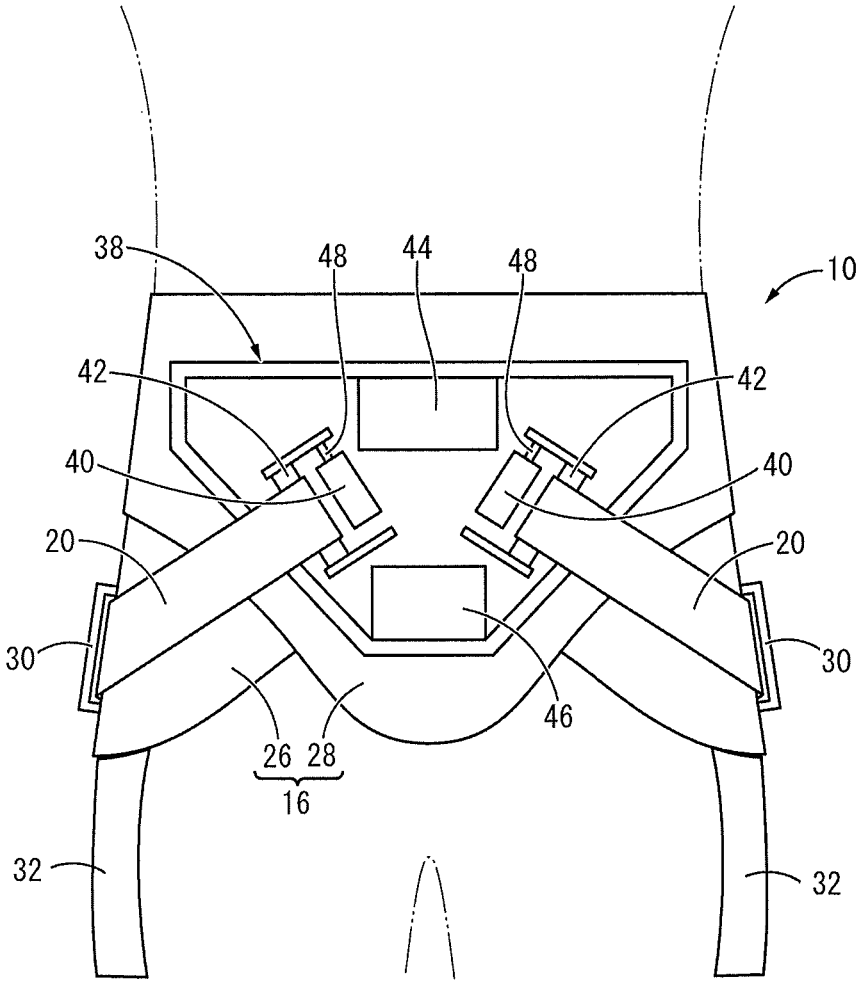
FIG. 7 is a drawing showing an internal structure of a drive device with a cover removed in the back view of the walking movement aid shown in FIG. 4.

As shown in FIG. 7, the drive device 38 is constituted including a left and right pair of electric motors 40, 40 as the drive source, a left and right pair of rotation shafts 42, 42 rotationally driven by that pair of electric motors 40, 40, a power supply device 44 such as a battery or the like that supplies power to the electric motors 40, 40, and a control device 46 that does operation control of the electric motors 40, 40 based on the detection results of the capacitance type sensors 32, 32. These electric motors 40, power supply device 44, control device 46 and the like are electrically connected by wire or wirelessly, but an illustration of that is omitted in FIG. 7.

The electric motors 40 are typical electric motor devices, and preferably, a servo motor or the like that can detect the rotation position and control the rotation volume in both the forward and reverse directions is used. Then, the rotational drive force on a drive shaft 48 of the electric motor 40 driven by the energization from the power supply device 44 is made to be transmitted to the rotation shaft 42 via a suitable speed reducing gear train. The rotation shaft 42 is a rod shaped member supported so as to allow rotation in the circumferential direction, and the other end of the second traction band 20 is fixed and wound on its outer circumferential surface. By doing this, the other end of the second traction band 20 is attached to the drive device support belt 28 via the drive device 38, and thus, the auxiliary force transmission band 12 is arranged extending across the hip joints.

Then, by having the rotation shaft 42 be rotated in one circumferential direction by the drive force applied from the drive shaft 48 of the electric motor 40, the second traction band 20 of the auxiliary force transmission band 12 is wound onto the rotation shaft 42. By doing this, the drive force by the electric motor 40 is transmitted in the length direction of the auxiliary force transmission band 12 (length direction of the first traction band 18 and the second traction band 20), and is applied as pulling force between the first wearing part 14 and the second wearing part 16. As is clear from the description above, the auxiliary force transmission band 12 extends in the transmission direction of the drive force of the electric motor 40. Meanwhile, when the rotation shaft 42 is rotated in the other circumferential direction by the electric motor 40, the winding of the auxiliary force transmission band 12 by the rotation shaft 42 is cancelled and fed out, and the pulling force between the first wearing part 14 and the second wearing part 16 is cancelled.

The reverse rotation of the electric motor 40 is not essential, and it is also possible to cancel the pulling force between the first wearing part 14 and the second wearing part 16 by stopping the supply of power to the electric motor 40 and setting a state whereby it is possible for the pulling of the auxiliary force transmission band 12 to be allowed freely. By doing this, it is possible to easily follow the walking movement because the auxiliary force transmission band 12 does not loosen excessively, and does not have tensile force of a level that will resist the movement.

Also, control of the electric motors 40 is executed by the presence or absence of energization and the energization direction (rotation direction of the drive shaft 48) to the electric motors 40 from the power supply device 44 by the control device 46. The control device 46 detects bending movement and stretching movement of the user's hip joints based on the detection results of the capacitance type sensors 32 (output signals), and controls the energization to the electric motors 40 according to the detected movement of the hip joints. By doing this, the pulling force applied between the first wearing part 14 and the second wearing part 16 based on the driving force of the electric motors 40 is adjusted by the control device 46. With this embodiment, the control device 46 specifies the walking operation stage (e.g. a specific hip joint angle such as the stage of bending the hip joint and carrying the back leg to the front, the stage of stretching the hip joint and kicking the ground with the front leg or the like), and is made to control energization to the electric motors 40 according to the hip joint angle which is the specified stage of the walking operation.

Figure 8:
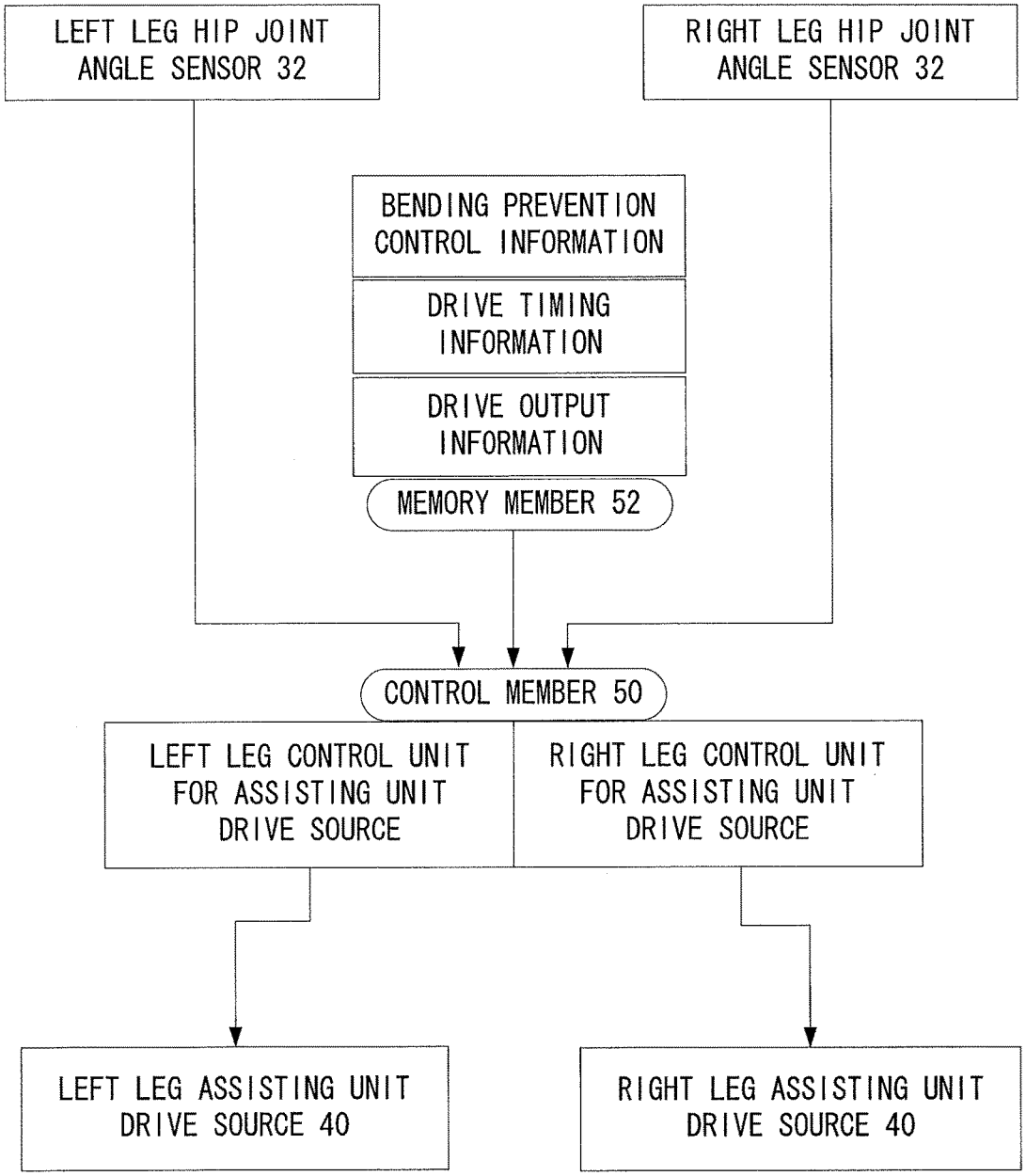
FIG. 8 is a functional block diagram showing a control system of the walking movement aid shown in FIG. 3.

Specifically, the control member 50 of the electric motors 40, 40 by the control device 46 uses the detected angle of the left and right hip joints as reference signals, and is made to execute power supply to the electric motors 40, 40 from the power supply device 44 so as to satisfy the control conditions of the electric motors 40, 40 corresponding to the hip joint angle of the preset specified stage. With this embodiment, as shown by the functional block diagram in FIG. 8, for example, this control member 50 is constituted to include a memory member 52 such as a RAM or the like in which is stored control information including drive timing information that specifies the timing of starting or stopping the supply of power to the electric motors 40 or the like in relation to changes in the hip joint angle, and drive output information that specifies the size of the power to be supplied to the electric motors 40 (winding volume of the auxiliary force transmission band 12 corresponding to the support force). The drive timing information or drive output information stored in this memory member 52 can have settings changed as necessary, for example for each user, it is possible to adjust the hip joint angle position at which the support force is exhibited, the size of the support force applied, and the like.

Then, according to the program stored in advance in the ROM or RAM of the memory member 52, when the hip joint angle reaches a power supply start or stop hip joint angle stored in advance in the memory member 52 with the reference signal being the hip joint angle output from the capacitance type sensors 32, 32 as the left and right hip joint angle sensors, the control unit of the control member 50 outputs a drive control signal so as to start or stop the supply of power to the electric motor 40 of the assisting unit from the power supply device 44 based on the control information such as the drive timing information or the drive output information or the like stored in advance in the memory member 52. Also, with this embodiment, the capacitance type sensors 32, the control units for the control member 50, and the electric motors 40 for driving the assisting unit are provided in a pair each independently at left and right, and control of the supply of power to the electric motors 40 by the control member 50 based on the control information of the memory member 52 is made to be executed separately for the left and right legs. In other words, the drive control signals by the control member 50 for controlling the electric motors 40, 40 for the left and right pair of assisting units are output independently from each other to the left and right leg.

Furthermore, as the drive output information stored in the memory member 52, is it also possible to include information for changing the power to be supplied to the electric motors 40 corresponding to the range of the hip joint angle (coefficient for multiplying the initial value of the winding volume or the like). By doing this, for example, it is possible to increase or decrease in stages or gradually the output of the electric motor 40 each time the hip joint angle reaches angles at a preset plurality of stages, and it is possible to make even more efficient the assistance force applied when walking, and to further reduce the sense of discomfort to the user.

Figure 9:
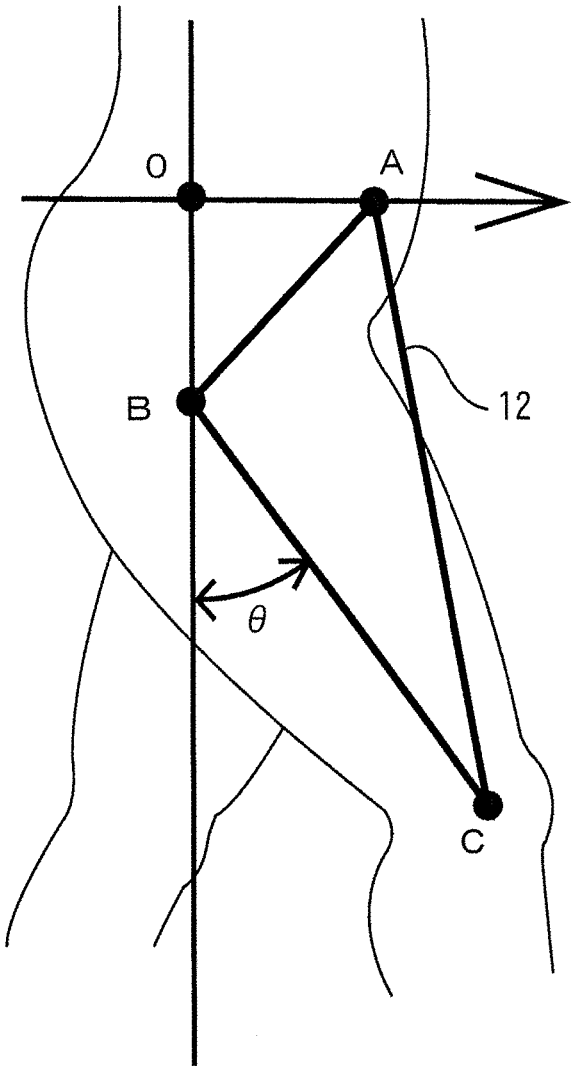
FIG. 9 is a view suitable for explaining changes in an effective free length of an auxiliary force transmission band of the walking movement aid shown in FIG. 3 according to the walking movement.

However, as shown in model form in FIG. 9, when the wearing position on the user of the upper end part of the auxiliary force transmission band 12 is the fulcrum point A, the hip joint position on the user is fulcrum point B, and the wearing position on the user of the lower end part of the auxiliary force transmission band 12 is the fulcrum point C, the length of side AC of a triangle ABC correlating to the length of the auxiliary force transmission band 12 changes according to the angle θ of the hip joints. The point O in FIG. 9 is the intersection of the horizontal line passing through the fulcrum point A and the vertical line passing through the fulcrum point B. Also, the position of the fulcrum point A is roughly the intermediate position of the attachment position on the transmission band support belt 26 of one end of the second traction band 20 and the guide fitting 30 in which the second traction band 20 is inserted.

Figure 10:
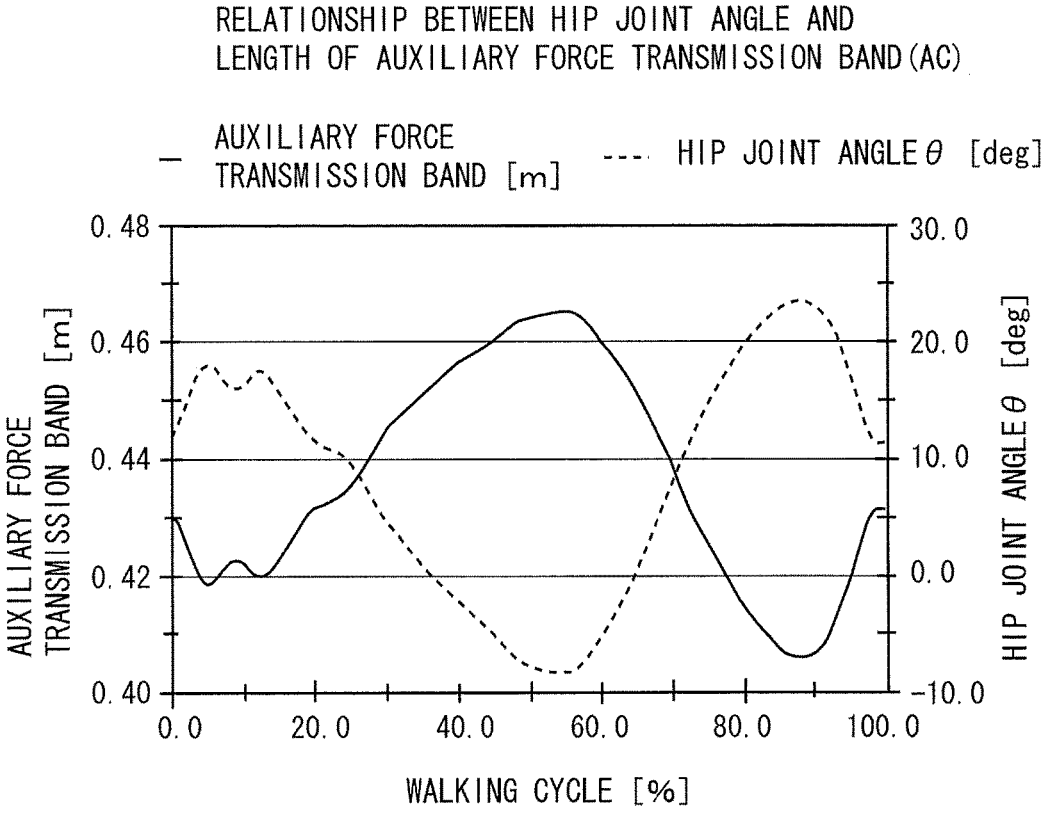
FIG. 10 is a view including a relational expression for explaining the relationship of the effective free length of the auxiliary force transmission band shown in FIG. 9 with a hip joint angle.
Figure 12:
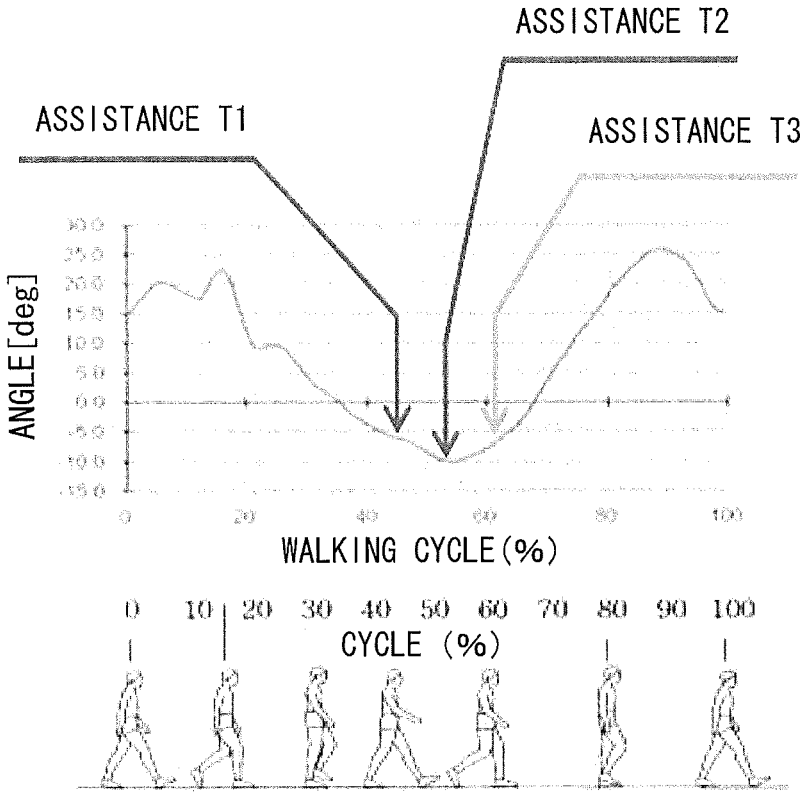
FIG. 12 is a view suitable for explaining the relationship between the support force acting period and the hip joint angle of the walking movement aid of the present invention.

Here, as shown in FIG. 10, the length of the auxiliary force transmission band 12 as this effective length (length of side AC) changes periodically according to the angle θ of the hip joint when walking, and that actual length can be found using the formula in FIG. 10. Then, with this embodiment, by controlling the forward and reverse rotation of the electric motors 40 so that the length of the auxiliary force transmission band 12 changes by a dimension correlating to the difference between the side AC calculated based on this formula and the reference length for which there is no bending of the side AC at a designated point in time in a walking cycle, the tensile force acting on the auxiliary force transmission band 12 during walking is maintained to be roughly constant (e.g. roughly ±0) and to have bending prevented. The walking cycle (%) which is the horizontal axis in FIG. 10 corresponds to the cycle (%) illustrated at the bottom side of FIG. 12 described later.

Figure 11:
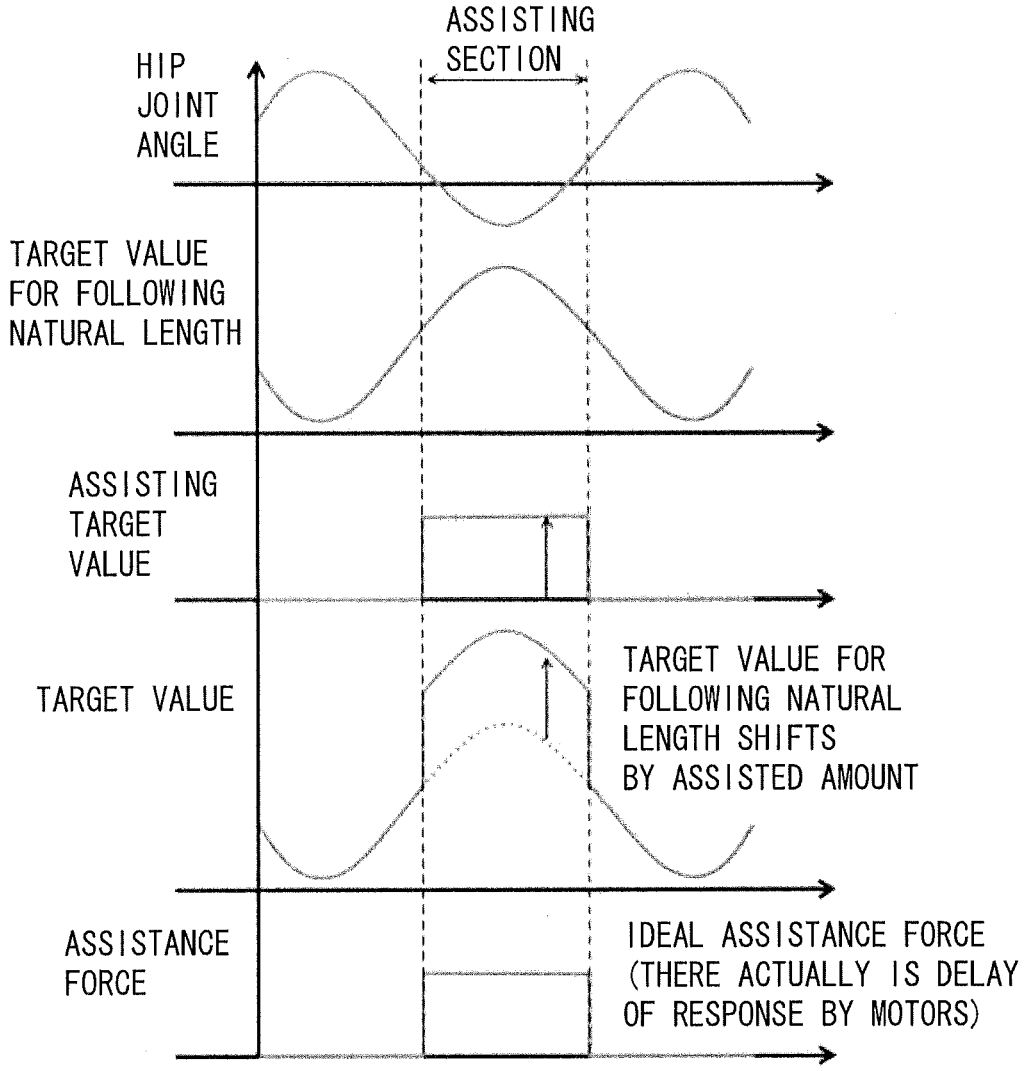
FIG. 11 is a view suitable for explaining the relationship between the support (assistance) force control and the effective free length change handling control of the auxiliary force transmission band of the walking movement aid shown in FIG. 3.

This kind of bending prevention control by tensile force adjustment of the auxiliary force transmission band 12 is realized by doing rotation operation of the electric motor 40 based on the relational expression stored in advance according to the hip joint angle θ when walking, and by adjusting the winding volume and feed volume of the second traction band 20. In specific terms, as shown by the functional block diagram in FIG. 8 described previously, this bending prevention control system is constituted including the memory member 52 such as RAM or the like in which is stored bending prevention control information including the coefficient of the expression described above for calculating the length of the auxiliary force transmission band 12 (length of side AC) in relation to changes in the hip joint angle, the reference length of the auxiliary force transmission band 12 at a designated point in time in the walking cycle, the rotation direction of the electric motor 40 corresponding to the windup and feed volume of the second traction band 20, and drive timing information for specifying the timing for starting and stopping the supplying of power. The drive timing information stored in this memory member 52 can have the settings changed as necessary, and can be adjusted to match the physique of each user, for example. Then, as shown in FIG. 11, this bending prevention control can be performed independently from the support force control corresponding to the hip joint angle described previously, and it is possible to do drive control of the electric motors 40 by the control member 50 outputting drive control signals so that both controls overlap and both control target values are achieved overlapping. With this kind of bending prevention control, the effective length of the auxiliary force transmission band 12 is made to follow and change in correspondence with changes in the hip joint angle, and the auxiliary force transmission band 12 is maintained in a roughly constant tensile force expanded state, so when the electric motor 40 is driven based on the support force control, there is almost no receiving of an adverse effect by changes in the length of the auxiliary force transmission band 12 corresponding to changes in the hip joint angle, and it is possible to give the target support force with stability and good precision to the user's leg.

If the walking movement aid 10 constituted as described above is worn, when bending the hip joint, auxiliary force (assistance force) is applied so as to reinforce the force needed for the bending movement of the hip joint, and it is possible to aid walking movement accompanied by bending and stretching of the hip joint. Specifically, when the control device 46 identifies for example that the user is trying to bend the hip joint forward based on the detection results of the capacitance type sensor 32, it energizes the electric motor 40 from the power supply device 44 and rotates the rotation shaft 42 in one circumferential direction. By doing this, the second traction band 20 is wound up by the rotation shaft 42, and since the substantial length of the second traction band 20 becomes shorter, so by the connecting fitting 22 fitted externally onto the middle part of the second traction band 20 being displaced by being pulled toward the second wearing part 16 side (top side), the length of the auxiliary force transmission band 12 becomes shorter. Then, pulling force is applied to the first wearing part 14 through the first traction band 18 attached to the connecting fitting 22, and the first wearing part 14 worn on the knee joint is pulled toward the second wearing part 16 side worn on the lumbar area. As a result, assistance force acts so as to pull the knee joint to the lumbar area side in resistance to gravity, and the muscle strength that performs walking movement accompanied by bending of the hip joints is aided. If the rotation force of the rotation shaft 42 (voltage supply to the electric motor 40) is adjusted by the control device 46 according to changes in the value of the hip joint angle θ detected by the capacitance type sensor 32, it is possible to more efficiently provide assistance force that is neither excessive nor insufficient to the operation the user is trying to perform. Also, by stopping the energization to the electric motor 40 when the value of the hip joint angle θ reaches a preset value, a sense of discomfort to the user by excessively supplementing or restricting movement of the hip joints is avoided.

Meanwhile, when the control device 46 identifies for example that the user is trying to extend the hip joint backward based on the detection results of the capacitance type sensors 32, it energizes the electric motor 40 from the power supply device 44 and rotates the rotation shaft 42 in the other circumferential direction. By doing this, the second traction band 20 is fed from the rotation shaft 42, and since the substantial length of the second traction band 20 becomes longer, the connecting fitting 22 fitted externally onto the middle part of the second traction band 20 is displaced in the direction (lower side) separating from the second wearing part 16 by the empty weight or elasticity or the like. Then, by the pulling force applied to the first wearing part 14 being canceled through the first traction band 18 attached to the connecting fitting 22, extension movement of the hip joint is kept from being obstructed by the walking movement aid 10.

In this way, if the walking movement aid 10 is worn, a portion of the force required when bending the hip joint is supplemented by the force generated by the electric motor 40, so it is possible to easily perform walking. Here, in FIGS. 2A to 2E described previously, when it is detected that the leg extended to the back has kicked off the ground and is in a single leg standing state based on the detection values of the left and right pair of capacitance type sensors 32, 32 as the joint angle sensors, the auxiliary force applied to the pair of legs by the electric motors 40 is controlled by the control member 50 of the control device 46 such that assistance force is applied in the forward swinging direction on the swinging leg B that kicked off the ground and aids the pendulum movement of the swinging leg B.

In specific terms, first, when doing the walking shown in model form in FIGS. 2A to 2E, the walking cycle is from the moment that one leg separates from the ground at the back and becomes the swinging leg B (2A), that swinging leg B is carried to the front by the pendulum movement around the hip joints (2B to 2D), until the moment the swinging leg B touches the ground in the front (2E). When this angle change of the hip joint during the walking cycle is detected based on the output value of the capacitance type sensor 32 described previously, as shown in FIG. 12, it was confirmed that it is possible to detect cyclical hip joint change patterns with practical use level precision. Because of that, by controlling the start, stop or the like of supplying power to the electric motor 40 at a designated timing specified in advance, as described above, it is believed that a walking muscle strength aid effect is exhibited.

The angle change width of the hip joints when walking, or the relative relationship between the phase of the hip joints and the muscle strength generated by each muscle differs according to the user's individual physique, walking style, habits or the like. Thus, the specific setting of, for example, at which point start or stop or the like of supplying of power to the electric motor 40 is executed among the points shown as assist T1, T2, and T3 in FIG. 12 preferably have the settings changed for each user. At that time, the determination of whether those set points are suitable for the user is performed by referencing the subjective opinion of the user, and in addition it is also possible to perform that based on the suitability determination results or the like of the support effect obtained by doing a comparison of the output values of the user joint electric potential sensor actually measured by changing the points for the start or stop or the like of supplying of power to the electric motor 40, for example.

Figure 13:
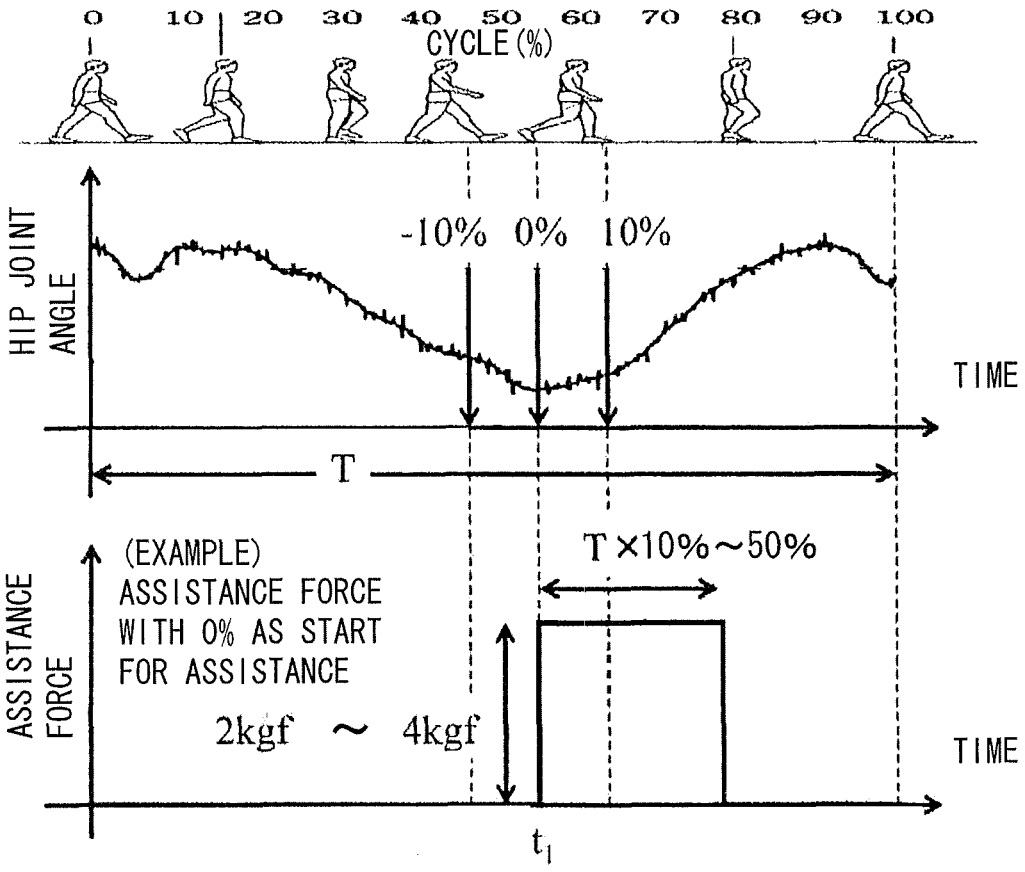
FIG. 13 is a view suitable for explaining the support force action timing of the walking movement aid of the present invention.

Typically, as shown in FIG. 13, in order to exert an effective assistance force at the stepping down stage of the swinging leg B, drive control of the electric motor 40 is performed by the control member 50 such that assistance force is applied to the swinging leg B from when it separates from the ground until it hangs vertically downward at the middle point. In specific terms, with the control member 50, with the position at which the leg extended to the back kicks off the ground as reference point t1, it is preferable that the assistance force start point in time is set based on the detection value of the hip joint angle sensors such that the start point is set to be within the range of −15% to +15% of the walking cycle from that reference point t1, and more preferably, the starting point is set to the position of 10% of the walking cycle from the reference point t1. In specific terms, as shown by example in FIG. 13, with the reference point t1 as the assistance force starting point, an example is shown of applying acting force of 2 to 4 kgf on the swinging leg B across the period of 10 to 50% of the walking cycle. This assistance force does not have to continue at a constant size, but can also change over time, or be made to act intermittently.

Figure 14A:
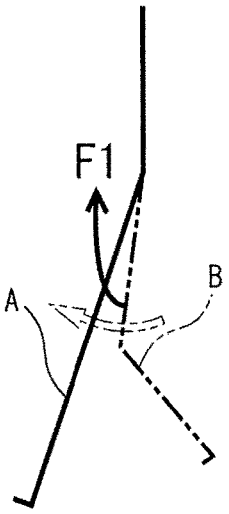
FIGS. 14A and 14B are specific views for explaining the support force action on the swinging leg with the walking movement aid shown in FIG. 3, where

Then, when the auxiliary force transmission band 12 worn on the swinging leg B is made to undergo pulling action, as shown in FIG. 14A, a support force F1 is applied in the direction pulling the thigh to the lumbar area. By this support force F1, the pendulum movement by which the thigh is swung forward around the hip joints is aided.

Figure 14B:
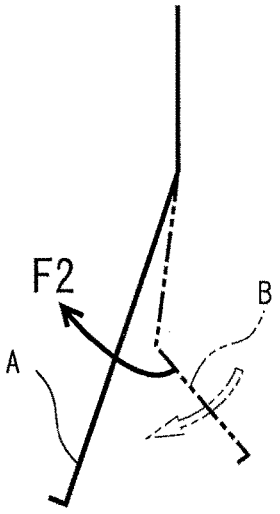

Also, with this embodiment, by the first wearing part 14*a* being attached to the thigh by the upper side winding part 14*a*, and also being attached to the lower leg by the lower side winding part 14*b*, the pulling force by the auxiliary force transmission band 12 is made to act directly not only on the thigh of the leg, but also on the lower leg. By doing this, as shown in FIG. 14B, a support force F2 is applied in the direction pulling the lower leg to the lumbar area. By this support force F2, the pendulum movement by which the lower leg swings to the front around the knee joint is aided.

In this way, by the assistance forces F1 and F2 in the forward swinging direction being applied to the swinging leg B when walking, in addition to the gravity action applied to itself or the reaction force of kicking off the ground when lifting from the ground or the like, the swinging leg B receives aid from the assistance force, and swings more efficiently in the forward direction. Then, the pendulum movement of this swinging leg B, particularly with this embodiment, the coupled motion of the pendulum movement around the hip joints of the thigh and the pendulum movement around the knee joints of the lower leg, is more efficiently exhibited, making it possible to effectively support walking movement using the movement energy of the swinging leg B.

Here, this aid applies assistance force to the swinging leg B, and aids the walking movement by making the pendulum movement of the swinging leg B more efficient. Thus, a large stimulus is applied by muscle strength or external force (body weight) to the grounding leg A supporting the body weight of the user, so it is sufficiently possible for a walking movement effect to be given to the muscles or bones.

In particular, with a person with decreased walking ability for which problems are tending to occur in the nervous system for the walking movement as well as in the walking muscles because of difficulty in walking, it is possible for the timing at which the support force is applied to the swinging leg B to be set appropriately so as to make the user aware of it. By doing this, there is an improvement in the awareness of the starting point of the pendulum movement of the swinging leg B as well as the suitability of the timing of the walking operation, and it is possible to expect a training effect that will restore the original independent walking.

In fact, since this assists the pendulum movement of the swinging leg B which from the start does not require large muscle strength compared to the grounding leg A, a large output is not required for the walking movement aid 10, and there is no excessive burden on the user wearing it because it is possible to make it smaller and lighter.

Also, the first traction band 18 of the auxiliary force transmission band 12 provided on the path for transmitting the drive force generated by the electric motor 40 as the assistance force to the user's leg can be elastically deformed in the force transmission direction. Therefore, the drive force generated by the electric motor 40 is applied to the user's leg after being eased by the elastic deformation of the first traction band 18. Because of that, compared to when the drive force generated by the electric motor 40 is transmitted directly, the burden on the user's joints and the like is reduced, and it is possible to prevent the occurrence of problems such as hurting the muscles or the like. In particular with this embodiment, it is preferable to have the assistance force applied to the user's leg be relatively small at approximately 2 kgf to 5 kgf. By doing this, a support force action is realized based on the concept of not forcing the user into movement but nothing more than compensating for insufficient muscle strength needed for movement, and it is possible to perform the necessary aid without adding a burden to the body of the user.

Furthermore, since the auxiliary force transmission band 12 is soft and deformable, it does not apply an excessive sense of constraint on the user as with the conventional exoskeleton type auxiliary force transmission device, and in particular even when a disturbance is input when pushed from the horizontal direction, the user's spontaneous and instantaneous movement is allowed, so it is possible to realize movement to avoid falling over.

In order to avoid the support force jarring action as well as to reduce the constraint on the user, it is preferable that the elasticity of the first traction band 18 in the transmission direction of the force be set between 0.3 kfg/cm$^2$ and 2.0 kgf/cm$^2$. By doing this, there is sufficient buffering of the drive force generated by the electric motor 40, and it is possible to avoid an excessive burden from acting on the user's leg, and also, an effective assistance force of an amount that allows sufficient spontaneous movement by the user is transferred to the user's leg, so it is possible to effectively aid movement.

Furthermore, the first traction band 18 has deformation in the direction roughly orthogonal to the force transmission direction restricted, and elasticity in the circumferential direction (diameter expansion deformation and diameter contraction deformation) of the first wearing part 14 formed as an integral unit with the first traction band 18 is inhibited, so shape stability is increased. By doing this, when the pulling force by the electric motor 40 acts, the first wearing part 14 is held without falling from the knee joint, and the assistance force is effectively transmitted to the leg.

With the walking movement aid 10 of this embodiment, the generation of assistance force according to the user movement state as described above is automatically executed by the control device 46 while referring to the control signals stored in the memory member 52 based on the detection results of the hip joint angle by the capacitance type sensors 32, so troublesome operation by the user is unnecessary. Also, with this embodiment, control of the support force on the left and right leg muscle strength is executed independently for each based on the left and right hip joint angle, so even in a case of a large change for only one leg hip joint angle due to stumbling on something, for example, it is also possible to easily realize control such as exhibiting a large support force based on the detection value of the hip joint angle of that one leg.

In fact, with this embodiment, from the fact that the capacitance type sensors 32 are used, the decrease in detection precision with respect to the temperature changes is small, and correction with respect to temperature changes is easy. Thus, it is possible to stably obtain a correct detection result even when the temperature change is large due to the user's body temperature change or the like accompanying walking movement, for example. Additionally, with the capacitance type sensors 32, since the decrease in the detection precision with repeated input is small, it is possible to ensure sufficient reliability, and possible to realize high precision for common use such as in everyday life or the like.

Also, with this embodiment, the auxiliary force transmission part is given sufficient flexibility by the auxiliary force transmission band 12 being formed using a thin cloth having a band form, so compared to a walking movement aid having a rigid exoskeleton, the walking movement aid 10 is easy to put on and take off. Specifically, when the rigid exoskeleton is worn by the user, the user has to adjust the bending angle of the joints to match the shape of the exoskeleton, and there are many cases when it is difficult to wear this sitting down. However, with the walking movement aid 10 of this embodiment, the auxiliary force transmission band 12 linking the first wearing part 14 and the second wearing part 16 is flexible and can bend as necessary, so if the auxiliary force transmission band 12 is made sufficiently long, regardless of what degree of angle the user's joint bends, it is possible to respectively attach the first wearing part 14 and the second wearing part 16 to suitable positions. In fact, by the auxiliary force transmission band 12 being flexible, for example, it is possible to wear the first wearing part 14 and the second wearing part 16 in a sitting orientation with the hip joints bent, and possible to perform the putting on and taking off tasks in a position of ease.

Furthermore, by using the auxiliary force transmission band 12 formed using a thin band form cloth, the walking movement aid 10 is made lighter, and it is possible even for an elderly person or the like with decreased muscle strength to handle it. In fact, with this embodiment, the first wearing part 14 and the second wearing part 16 are both made of cloth as well, so the overall walking movement aid 10 is made even lighter, and there is further improvement in handleability including the putting on and taking off tasks.

Yet further, by the auxiliary force transmission band 12 being made of thin cloth, in the worn state, the auxiliary force transmission band 12 is arranged along the shape of the user's body surface, and also bends easily in the thickness direction along the body surface. Because of that, it is possible to wear clothing over the walking movement aid 10, and to use it comfortably without standing out in daily life activities.

Also, by having the first wearing part 14 attached to the knee joints, and the second wearing part 16 attached to the lumbar area, the length of the auxiliary force transmission band 12 is prevented from becoming longer than necessary, and while making the walking movement aid 10 more compact, assistance force is applied efficiently to the legs. Probably, this is because when the separation distance from the hip joints (fulcrum point B in FIG. 9) which are the fulcrum points during swinging of the thighs up to the first and second wearing parts 14 and 16 (respectively fulcrum points C and A in FIG. 9) which are the action points becomes large, the support force by the pulling force acts efficiently on the legs. Furthermore, when at least a portion of the auxiliary force transmission band 12 is formed using a rubber sheet or the like, for example, in addition to the support force by the pulling force, it is also possible to have elastic restoring force act efficiently on the leg. In fact, by having the drive device 38 provided on the lumber area which has little movement volume during walking, it is possible to reduce the obstruction of walking movement by the drive device 38.

Figure 15:
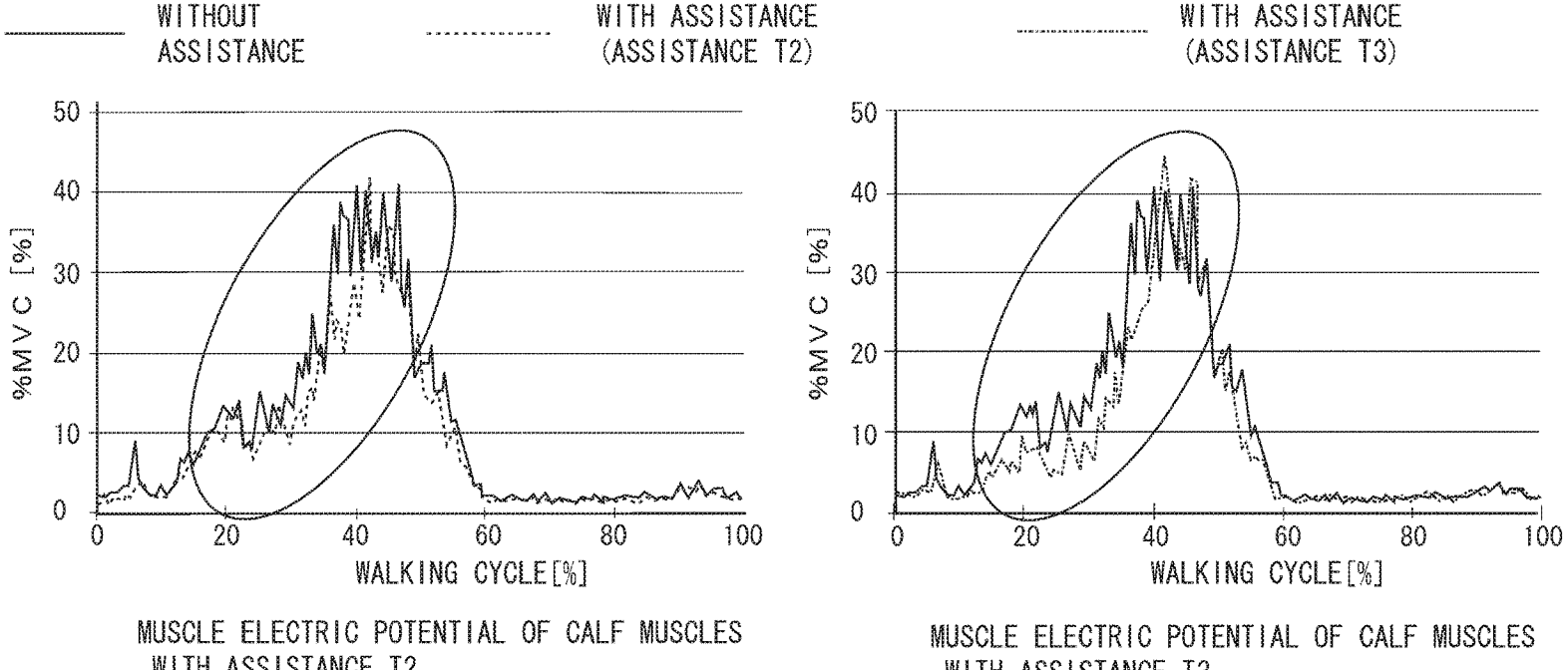
FIG. 15 is a graph showing the experiment results confirming the effect of the muscle strength support (assistance) by the walking movement aid shown in FIG. 3.

Incidentally, the walking movement aid 10 constituted according to this embodiment was actually worn by a non-handicapped person, and an experiment was performed to confirm the support effect when walking. When doing this experiment, a muscle electric potential sensor was worn on a muscle site surface such as the calf muscles. Then, detection of the muscle electric potential detection waveform was done and compared the cases when there is assistance with support force applied, and when there isn't assistance, with support force not applied. One of these results is shown in FIG. 15. In each experiment result shown, with the hip joint angle θ as the reference signal, the support force action start timing was set to point T2 and point T3 in FIG. 12 described previously. As shown in FIG. 15, by applying support force, it was possible to confirm that an effective support effect is exhibited with a decrease in muscle electric potential in the area of 20 to 40% of the walking cycle.

Above, we gave a detailed description of an embodiment of the present invention, but the present invention is not limited to those specific descriptions. For example, the wearing position of the control device 46 and the power supply device 44 is not restricted, and for example, they can also be worn housed in a pocket of the user's clothing as an independent structure connected by a conductive lead wire, worn on the user's shoulder or the like. Also, the drive source for generating assistance force is not limited to being an electric motor, and it is also possible to use artificial muscles or the like.

Furthermore, the joint angle sensor for detecting user movement is not limited to being a capacitance type sensor, and it is also possible to use, for example, a resistance change type sensor that detects user movement based on changes in the resistance value according to force action. If this kind of resistance change type sensor is used, it is possible to do measurement using DC voltage, so it is easy to simplify the measurement circuit, and easy to realize smaller size and lower costs. In fact, since the resistance value changes acutely for even small force actions, it is possible to do broad ranging detection from slight movement to big movement of the joints. As the resistance change type sensor, for example it is preferable to use an item having flexibility as shown in U.S. Pat. No. 7,563,393. It is also possible to use a combination of a plurality of types of sensors with different structures and detection methods, such as using a combination of capacitance type sensors and resistance change type sensors.

Figure 16:
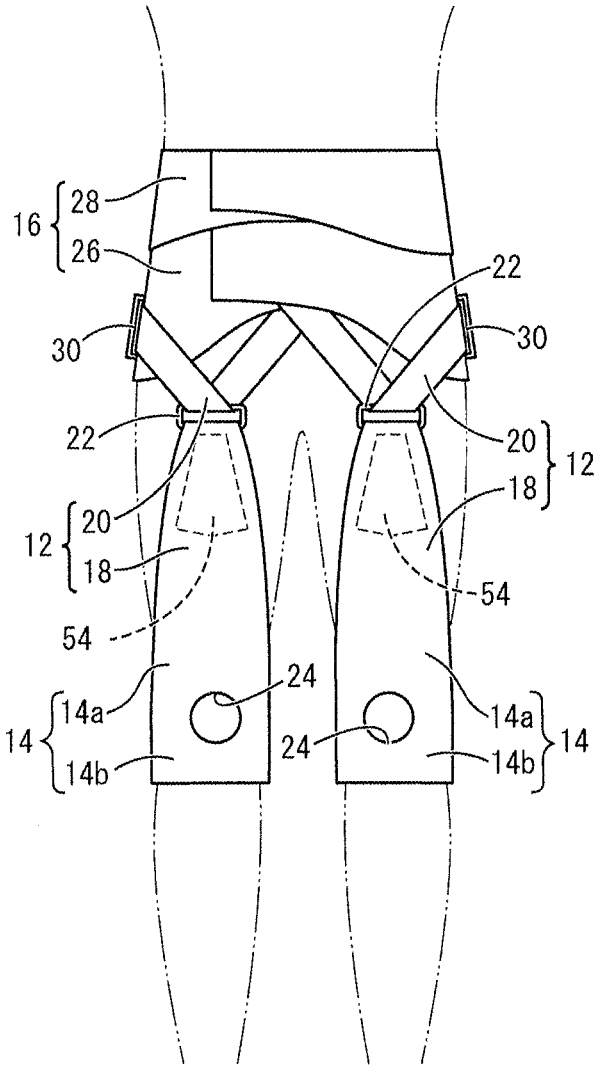
FIG. 16 is a front view showing another mode example of the joint angle sensor of the walking movement aid shown in FIG. 3.
Figure 17:
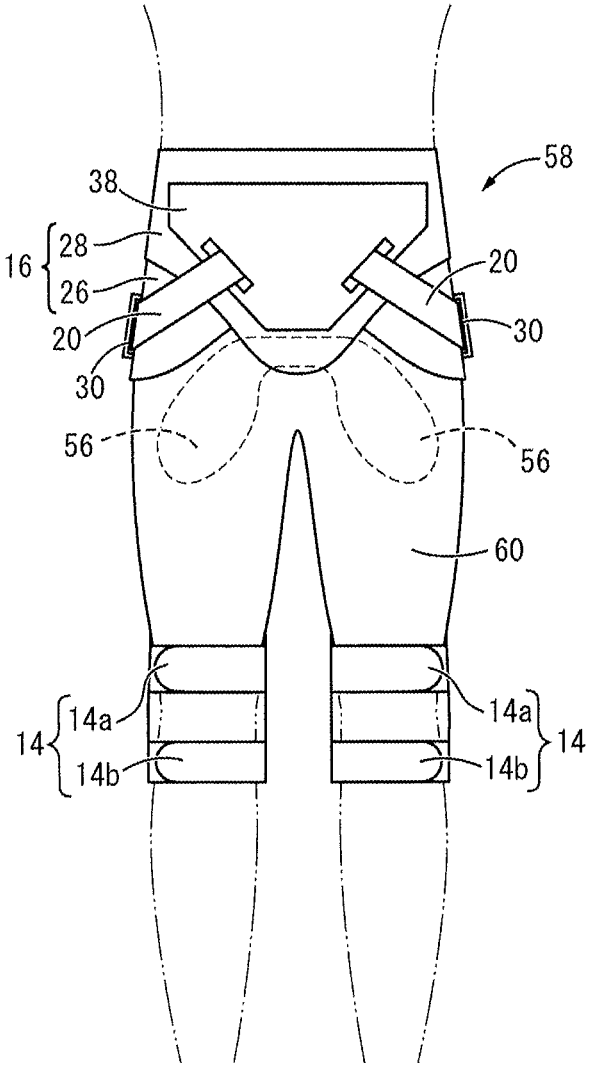
FIG. 17 is a front view showing yet another mode example of the joint angle sensor of the walking movement shown in FIG. 3.

Also, for example, as shown in FIG. 16, by having a capacitance type sensor 54 worn on the rear surface of the first traction band 18 (surface overlapping the thigh) and wearing it overlapping the thigh front surface, it is possible to detect the gripping pressure between the first traction band 18 and the thigh accompanying deformation of the thigh muscle when bending the hip joints as changes in capacitance. Alternatively, for example, as shown in FIG. 17, if a capacitance type sensor 56 that broadens from the user's buttocks toward the thigh is used, it is possible to more directly detect bending and stretching of the hip joints. In this case, a walking movement aid 58 is constituted including a pants (leggings) shaped sensor holding suit 60 equipped with the capacitance type sensor 56 in addition to the auxiliary force transmission band 12 and the first and second wearing parts 14 and 16, and after putting on the sensor holding suit 60, the auxiliary force transmission band 12 and the first and second wearing parts 14 and 16 are put on. The capacitance type sensors 54 and 56 shown in FIG. 16 and FIG. 17 can have a basic structure that is the same as that of the capacitance type sensors 32 shown in the embodiment. Also, the capacitance type sensor 54 worn on the front surface of the thigh and the capacitance type sensor 56 worn on the surface of the buttocks as shown in FIG. 16 and FIG. 17 can be attached to the user's body surface or the like at both vertical end parts. Then, for example, using a reaction change accompanying pulling deformation when the foot steps down, and ease of the pulling deformation when the foot kicks off, it is possible to detect the swinging angle in the front and back direction of the hip joints. Furthermore, as the joint angle sensor, it is also possible to use sensors that directly detect angles such as a rotary encoder or the like, and to directly detect the hip joint angle.

Also, the auxiliary force transmission part is not necessarily limited to being an item having flexibility (softness) in its entirety, and can partially have rigid parts formed using metal, synthetic resin or the like. Furthermore, it is also possible to have the entire auxiliary force transmission part be elastically deformable in the force transmission direction, or to have the auxiliary force transmission partially allow elastic deformation in the force transmission direction.

Yet further, with the embodiment noted above, the bottom ends of the auxiliary force transmission band 12 were respectively attached to the thigh and the lower leg at the first wearing part 14. For example, as the auxiliary force transmission band worn on each leg, it is possible to use a combination of a first auxiliary force transmission band attached to the thigh at the bottom end, and a second auxiliary force transmission band attached to the lower leg at the bottom end. By doing this, the pendulum movement assistance force action on the thigh and the pendulum movement assistance force action on the lower leg are more efficiently performed at individual timings and sizes, and it is possible to realize more efficient aiding of the coupled pendulum movement by the thigh and the lower leg.

It is also possible to attach the bottom end of the auxiliary force transmission band to only the lower leg using the first wearing part. In that case as well, the assistance force applied to the lower leg is effectively transmitted and acts as an assistance force on the thigh via the knee joint, so it is possible to realize effective support on the pendulum movement of the leg.

Furthermore, after grounding, it is also possible to apply pulling force using the auxiliary force transmission band 12 on the grounding leg A extended to the front as well. By doing this, resist force is applied to the leg, and by increasing the muscle strength load applied to the user when walking compared to with normal walking, it is possible to increase the muscle strength training effect. By giving this kind of resistance force to the user, for example it is possible to more effectively promote restoration of muscle strength to patients with decreased muscle strength. Furthermore, when the restoration of muscle strength is confirmed, by in stages or gradually increasing the size of pulling force and increasing the muscle strength burden on the patient, further muscle strength restoration is promoted, and improvement or prevention of conditions such as locomotive syndrome and the like can be expected.

With the present invention, it is possible to omit the memory member 52 from the control member 50, and for example it is possible to have the electric motor 40 driven with a detection value of the joint angle sensor that detects a specified state such as of the timing at which the user's leg extended to the back kicks off the ground and goes to a single leg standing state as the trigger.

What is claimed is:

1. A swinging leg pendulum movement aid for walking, comprising:

a pair of assisting units for a left leg and a right leg, each of the assisting units including an auxiliary force transmission part having flexibility, a first wearing part configured to be worn on a leg side with respect to a user's hip joint, a second wearing part configured to be worn on a lumbar side with respect to the user's hip joint, and a drive source for applying a pulling force to the auxiliary force transmission part, the first wearing part and the second wearing part are disposed at opposite end parts of the auxiliary force transmission part;

a joint angle sensor for detecting a joint angle of a front-back direction of the user's hip joints; and a control member adapted to detect from a detection value of the joint angle sensor a state for which a leg that extended to a back when the user is walking has kicked off a ground and becomes a single leg standing state, implements drive control on the drive source, and applies the pulling force to the auxiliary force transmission part of the leg that kicked off the ground so as to apply an assistance force in a forward swinging direction to aid a pendulum movement of the leg that kicked off the ground, the leg that kicked off the ground thus being swinging leg, wherein the drive source includes a pair of electric motors and a pair of rotation shafts rotationally driven by the pair of electric motors, each provided at the second wearing part, the auxiliary force transmission part is formed with a flat band and is configured to be arranged so as to cover a front surface of the user's thigh, one end of the auxiliary force transmission part is fixed to the first wearing part and an other end of the auxiliary force transmission part is fixed on an outer circumferential surface of the corresponding rotation shaft, and when the control member detects the single leg standing state, the electric motor of the corresponding one of the assisting units for the swinging leg is energized to rotate the rotating shafts so that the auxiliary force transmission part is wound up by the rotation shaft to be shorter and the pulling force is applied to the first wearing part via the auxiliary force transmission part and the first wearing part worn on the leg side is pulled toward the second wearing part worn on the lumbar side, the first wearing part and the second wearing part are connected by the auxiliary force transmission part having flexibility, but not by a rigid exoskeleton leg structure, and the auxiliary force transmission part is adapted to be arranged along a shape of the user's body surface and bend in a thickness direction along the body surface; and further comprising a memory member for storing control information relating to drive timing information and drive output information for driving each drive source with the left and right pair of assisting units corresponding to changes in the joint angle with the user's hip joints, wherein the memory member stores auxiliary-force-transmission-part-bending prevention control information to follow an effective length of the auxiliary force transmission part of the assisting unit corresponding to changes in the joint angle of the user's hip joints in order to prevent flection of the auxiliary force transmission part, and the control member does drive control of the respective drive sources of the left and right pair of assisting units so as to keep a fixed tensile force action state of the auxiliary force transmission part corresponding to changes in the joint angle based on the auxiliary-force-transmission-part-bending prevention control information stored in the memory member.

2. The swinging leg pendulum movement aid for walking according to claim 1, wherein the first wearing part of the assisting unit is configured to be worn within a range from a distal end of a femur to a proximal end of a tibia.

3. The swinging leg pendulum movement aid for walking according to claim 2, wherein by the first wearing part of the assisting unit being worn at the proximal end of the tibia, the assistance force by the assisting unit is configured to be implemented at a below the knee part of the swinging leg.

4. The swinging leg pendulum movement aid for walking according to does drive control of each drive source with the left and right pair of assisting units based on the control information of the memory member, and aiding of the pendulum movement of the swinging leg is done by the joint angle sensor detecting the leg extended to the back during walking by the user having kicked off the ground and reached a single leg standing state, and applying the assistance force in the forward swinging direction on the swinging leg.

5. The swinging leg pendulum movement aid for walking according to claim 4, wherein an output of the electric motor is controlled each time the hip joint angle reaches angles at a preset plurality of stages based on the drive output information for changing the power to be supplied to the electric motors corresponding to a range of the hip joint angle.

6. The swinging leg pendulum movement aid for walking according to claim 1, wherein the control member is further adapted to refer a position at which the leg extended to the back during walking by the user kicks off the ground and becomes the swinging leg as a reference point, and sets a start point of the assistance force based on the detection value of the joint angle sensor such that the start point is set within a range of −15% to +15% of a walking cycle from the reference point.

7. The swinging leg pendulum movement aid for walking according to claim 6, wherein with the reference point as an assistance force starting point, acting force of 2 to 4 kgf is applied on the swinging leg across a period of 10 to 50% of the walking cycle.

8. The swinging leg pendulum movement aid for walking according to claim 1, wherein the joint angle sensor comprises a sensor made to detect an incline angle in the front-back direction of a femur in relation to a hip bone of the user individually for the left and right leg.

9. The swinging leg pendulum movement aid for walking according to claim 1, wherein the control member performs drive control of the respective drive sources based on the auxiliary-force-transmission-part-bending prevention control information independent from drive control of the respective drive sources to apply the assistance force based on the detection value of the joint angle sensor.

10. The swinging leg pendulum movement aid for walking according to claim 1, wherein the control member performs drive control of the respective drive sources based on the based on the auxiliary-force-transmission-part-bending prevention control information such that provided one end of the auxiliary force transmission part on a side of the first wearing part is considered a fulcrum point A, the user's hip joint is considered as a fulcrum point B, and another end of the auxiliary force transmission part on a side of the second wearing part is considered a fulcrum point C, a length of AC of a triangle ABC corresponding to a length of the auxiliary force transmission part is calculated a following formula (1), and the length of the auxiliary force transmission part changes by a dimension correlating to a difference between the length of AC obtained by the formula (1) and a reference length for which there is no bending of the length of AC at a designated point in time in a walking cycle, $$AC = \sqrt{AB^2 + BC^2 - 2AB \cdot BC\cos\left(\pi - \tan^{-1}\frac{OA}{OB} - \theta\right)}, \quad (1)$$

where O is an intersection of a horizontal line passing through the fulcrum point A and a vertical line passing through the fulcrum point B, and θ is an angle of the user's hip joint at the designated point in time in the walking cycle.

11. The swinging leg pendulum movement aid for walking according to claim 1, wherein the first wearing part has a through hole formed to be aligned with the user's knee cap.

* * * * *